US011835919B2

(12) United States Patent
Yamashita et al.

(10) Patent No.: US 11,835,919 B2
(45) Date of Patent: Dec. 5, 2023

(54) TONER CLASSIFICATION APPARATUS AND A TONER PRODUCTION METHOD

(71) Applicant: CANON KABUSHIKI KAISHA, Tokyo (JP)

(72) Inventors: Daisuke Yamashita, Chiba (JP); Junichi Tamura, Ibaraki (JP); Ran Wakayama, Kanagawa (JP); Katsuyuki Katoh, Kanagawa (JP); Yuichi Mizo, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 245 days.

(21) Appl. No.: 17/533,905

(22) Filed: Nov. 23, 2021

(65) Prior Publication Data

US 2022/0179332 A1 Jun. 9, 2022

(30) Foreign Application Priority Data

Dec. 3, 2020 (JP) ..... 2020-200999

(51) Int. Cl.
*G03G 15/08* (2006.01)
*G03G 9/08* (2006.01)
(Continued)

(52) U.S. Cl.
CPC ..... *G03G 9/0817* (2013.01); *G03G 9/0819* (2013.01); *G03G 9/08755* (2013.01);
(Continued)

(58) Field of Classification Search
CPC ..... G03G 9/0817; G03G 9/0819; G03G 9/08755; G03G 9/08782; G03G 9/0912; B07B 7/083
See application file for complete search history.

(56) References Cited

U.S. PATENT DOCUMENTS

2002/0182528 A1* 12/2002 Nakanishi ..... G03G 9/087 241/24.28
2006/0063091 A1* 3/2006 Makino ..... B07B 9/02 430/110.4

(Continued)

FOREIGN PATENT DOCUMENTS

JP 2001-201890 7/2001
JP 2008-026457 2/2008

(Continued)

*Primary Examiner* — Hoang X Ngo
(74) *Attorney, Agent, or Firm* — Venable LLP

(57) ABSTRACT

A toner classification apparatus comprising a classification rotor, wherein the classification rotor comprises a first vane group containing first vanes and a second vane group containing second vanes, the second vanes have a length shorter than the first vane group; the number of second vanes, which are disposed between two adjacent first vanes, is 1 to 2, independently; each of the first vanes draws first trajectory and each of the second vanes draws second trajectory when the classification rotor rotates, a distance from the center of rotation to an outer circumference side end of the first and second trajectory are defined as L1 and L3, respectively, and a distance from the center of rotation to the center side end of the first and second trajectory are defined as L2 and L4, respectively, L1 to L4 satisfy prescribed relationships, and a toner production method using the toner classification apparatus.

8 Claims, 13 Drawing Sheets

(51) Int. Cl.
*G03G 9/087* (2006.01)
*G03G 9/09* (2006.01)

(52) U.S. Cl.
CPC ..... *G03G 9/08782* (2013.01); *G03G 9/0912* (2013.01); *G03G 2215/00898* (2013.01)

(56) References Cited

U.S. PATENT DOCUMENTS

2010/0072115 A1* 3/2010 Makino ..... B07B 4/06
209/644
2021/0397104 A1 12/2021 Yamashita et al.

FOREIGN PATENT DOCUMENTS

JP 2010-160374 7/2010
JP 2011-237816 11/2011

* cited by examiner

CROSS-SECTIONAL VIEW
TAKEN ALONG A-A'

CROSS-SECTIONAL VIEW
TAKEN ALONG A-A'

CROSS-SECTIONAL VIEW
TAKEN ALONG A-A'

TONER CLASSIFICATION APPARATUS AND A TONER PRODUCTION METHOD

BACKGROUND OF THE INVENTION

Field of the Invention

The present disclosure relates to a toner classification apparatus that is used in an electrophotographic system, an electrostatic recording system, and a toner jet system, and to a toner production method.

Description of the Related Art

In recent years, full color electrophotographic copiers have become widely disseminated and have also begun to be used in the commercial printing market. The commercial printing market requires high speeds, high image quality, and high productivity, while accommodating a broad range of media (paper types). With regard to toner, an increased image quality can be pursued through stabilization of the developing performance and transferability based on, inter alia, a stabilization of the charging performance provided by toner that has a small particle size and a sharp particle size distribution.

The melt-kneading/pulverization method is known as one of the common toner production methods. A specific example of a toner particle production method using the melt-kneading/pulverization method is as follows. Toner starting materials, e.g., binder resin, colorant, release agent, and so forth, are melt-kneaded followed by cooling and solidification and then microfine-sizing of the kneadate using pulverization means to obtain a toner particle. As necessary, this is followed by, e.g., classification into a desired particle size distribution, adjustment of the circularity by toner particle spheronization using a heat treatment, and addition of a fluidizing agent such as inorganic fine particles, to produce the toner.

A variety of pulverization apparatuses are used as kneadate pulverization means. For example, the mechanical pulverization apparatus is a mechanical pulverization apparatus that is provided with a casing having an outlet port and an inlet port for the material to be pulverized (Japanese Patent Application Laid-open No. 2011-237816). The following are provided within this casing: a rotor supported on a central rotational axle and having on its outer peripheral surface a plurality of protruded portions and depressed portions, and a fixed element which is disposed to the outside of this rotor at a prescribed gap from the outer peripheral surface of the rotor and which has on its inner peripheral surface a plurality of protruded portions and depressed portions. While a material to be pulverized is being carried on an air flow from the inlet port to the outlet port and is passing through a processing space, where the rotor and fixed element face each other, the material to be pulverized is pulverized by impact with the protruding portions or depressed portions of the rotor or fixed element.

In addition, particles generated during the pulverization step and having too small diameter are admixed in the pulverized material provided by pulverization, by the pulverization apparatus, to the desired particle diameter. These particles having too small diameter, when present in toner, create problems for the electrophotographic process, e.g., fogging and so forth, and due to this the particles having too small diameter are generally removed by a classification process.

The following, for example, are known as toner production methods that have a classification process that uses a classification apparatus: the toner production method (Japanese Patent Application Laid-open No. 2001-201890), which uses an air flow classification apparatus that employs the Coanda effect, and the toner production method described (Japanese Patent Application Laid-open No. 2008-26457), which uses a centrifugal wind force classifier.

When a centrifugal wind force classifier is used, the pulverized material—which comprises the particles to be classified and derives from the toner starting material kneadate—is transported from the inlet port to the vicinity of the outer circumference of a classification rotor by an air flow that is directed from the outer circumference side to the inside of the classification rotor. Due to the rotation of the classification rotor, a centrifugal force is applied at the outer circumference of the classification rotor. The centrifugal force acting on the particles to be classified is a force directed to the outside of the classification rotor and is proportional to the particle mass, and due to this the centrifugal force acting on the particles having too small diameter in the particles to be classified is smaller than the drag imparted by the air flow directed from the outer circumference side to the inside of the classification rotor. As a consequence, classification proceeds as follows: a classified material is obtained by removal of the particles having too small diameter from the particles to be classified by passage between the vanes of the classification rotor and recovery by means for recovering particles having too small diameter that communicates with the inside of the classification rotor, and the classified material from which the particles having too small diameter have been thusly removed is recovered using classified material recovery means disposed to the outside of the classification rotor.

It is also proposed to use a toner production method, which uses classification means that has a plurality of vanes lined up at a certain interposed gap on the same circumference, with each vane making an angle θ of from 20° to 65° with respect to the straight line connecting the center of the classification rotor with the tip of the vane (Japanese Patent Application Laid-open No. 2010-160374). The classification means used in this production method causes the generation of a vortex by dividing the air entering between the vanes from the outside of the rapidly rotating classification rotor into a component in the direction of the center of rotation and a component expelled to the outside of the classification rotor.

SUMMARY OF THE INVENTION

As noted above, the classification process is performed by adjusting the balance between the drag force and centrifugal force acting on the particles to be classified. However, in some cases particles that should not be taken in as particles having too small diameter also end up being suctioned off and removed in error; this occurs due to factors such as the occurrence of turbulence in the air flow in the classification apparatus, the occurrence of aggregation between the particles to be classified, the occurrence of variability in the velocity when the particles to be classified approach the classification rotor, and the occurrence of a vortex between the vanes of the classification rotor. As the average particle diameter of the particles to be classified approaches the particle diameter of the particles having too small diameter, which should be removed by the classification step, the ratio of removal due to erroneous suctioning off becomes larger, and as a result a reduction in the yield for the classification step has been observed when smaller toner particle sizes are pursued.

It is thought that the vortex generated in the toner production method described in Japanese Patent Application Laid-open No. 2010-160374 is generated by the configuration along the vanes. When the angle θ is present, a vortex is generated more at the outer side of the rotor than for a classification rotor which is disposed on the aforementioned radial straight line, and as a consequence the ratio of erroneous suctioning off of the particles to be classified is smaller and an improved yield has been observed. However, when this angle θ becomes too large, the vane-to-vane gap on the inner side of the classification rotor becomes too narrow, and as a consequence pass-through by the particles having too small diameter are also impeded and the inability to achieve a satisfactory removal of the particles having too small diameter and increase of a pressure loss have also been observed.

As noted above, smaller particle sizes are being required of toner in order to boost the image quality. The dominant factor for the particle diameter of the ultimately obtained toner is the particle diameter of the pulverized material yielded by the pulverization step after the mixture of toner starting materials has been melt-kneaded. The particle size of the pulverized material thus has to be reduced in order to reduce the particle size of the toner. The classification step is a step in which the particles having too small diameter, which may be a problematic factor for the electrophotographic process, are removed. However, when the toner particle size is reduced, the average particle diameter of the pulverized material becomes close to the particle size of the particles having too small diameter, which are the particles that are to be removed by the classification step. As a consequence, the problem arises of a reduction in the yield due to the concomitant removal, partly as particles having too small diameter, of particles that should not be removed because they have a diameter suitable for the toner.

In addition, when classification is performed using a centrifugal wind force classifier, in order to prevent capture of the particles to be classified that should not be removed, means such as increasing the number of vanes of the classification rotor and increasing the angle θ formed by each vane with respect to a straight line connecting the center of the classification rotor and the tip of the vane can be considered. However, in these cases, there are problems that the pressure loss due to the classification rotor becomes large and the load on the blower becomes large.

The present disclosure solves the problem by providing a toner classification apparatus and toner production method that demonstrate an excellent yield even in the production of small diameter toner.

The present disclosure relates to a toner classification apparatus comprising a classification rotor, wherein

- the classification rotor comprises a plurality of vanes extending from a side of a center of rotation of the classification rotor to an outer circumference side of the classification rotor;
- the plurality of vanes are disposed with prescribed gaps established between the vanes;
- the gaps form an opening connecting a region of the center of rotation of the classification rotor;
- the plurality of vanes comprise a first vane group containing first vanes and a second vane group containing second vanes, the second vanes have a length shorter than the first vanes;
- the first vanes have substantially the same vane length, and are disposed with gaps established between the first vanes, each of the first vanes draws first trajectory when the classification rotor rotates, first trajectories drawn by the first vanes are substantially same;
- the second vanes have substantially the same vane length, and are disposed with gaps established between the second vanes,
- each of the second vanes draws second trajectory when the classification rotor rotates, second trajectories drawn by the second vanes are substantially same;
- the number of second vanes, which are disposed between two adjacent first vanes, is 1 to 2, independently;
  - a distance from the center of rotation to an outer circumference side end of the first trajectory is defined as L1 for the first trajectory, and
  - a distance from the center of rotation to the center side end of the first trajectory is defined as L2,
  - a distance from the center of rotation to an outer circumference side end of the second trajectory is defined as L3 for the second trajectory, and
  - a distance from the center of rotation to the center side end of the second trajectory is defined as L4, L1 to L4 satisfy the following relationships:

$$0.25 \leq (L3-L4)/(L1-L2) \leq 0.50$$

$$0.95 \leq L3/L1 \leq 1.05.$$

In addition, the present disclosure relates to a toner production method comprising

- a classification step in which a particle to be classified is subjected to a classification process using a toner classification apparatus,
- wherein the toner classification apparatus is the toner classification apparatus of the present disclosure.

According to the present disclosure, a toner classification apparatus and toner production method that demonstrate an excellent yield even in the production of small diameter toner can be provided.

Further features of the present disclosure will become apparent from the following description of exemplary embodiments with reference to the attached drawings.

DESCRIPTION OF THE EMBODIMENTS

Figure 1:
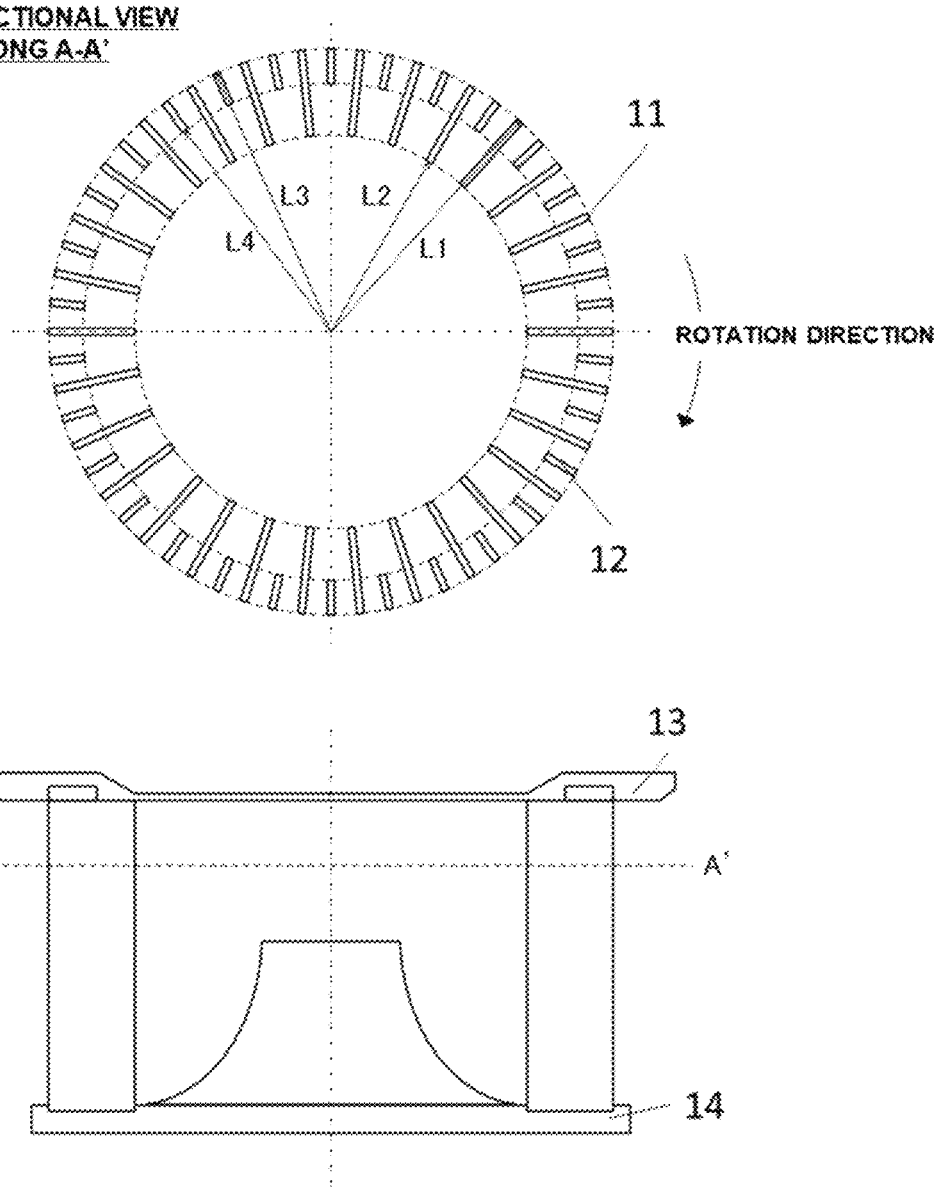
FIG. 1 is a schematic diagram of a classification rotor used in Example 1.

Unless specifically indicated otherwise, the expressions "from XX to YY" and "XX to YY" that show numerical value ranges refer in the present disclosure to numerical value ranges that include the lower limit and upper limit that are the end points.

The reference numerals in the drawings are as follows.

11. first vane, 12. second vane, 13. upper part of classification rotor frame, 14. lower part of classification rotor frame, 31. classification rotor, 32. dispersion rotor, 33. dispersion hammer, 34. introduction port for particles to be classified, 35. supply means for particles to be classified, 36. guide means, 37. classified material take-off port, 38. liner, 39. particles having too small diameter discharge port, 40. particles having too small diameter recovery means (cyclone), 41. blower, 42. static pressure gauge, 51. guide means support member FIG. 1 provides a schematic drawing of a classification rotor that is provided in a toner classification apparatus. The classification rotor comprises a plurality of vanes extending from a side of a center of rotation of the classification rotor to an outer circumference side of the classification rotor;

the plurality of vanes are disposed with prescribed gaps established between the vanes;

the gaps form an opening connecting a region of the center of rotation of the classification rotor;

the plurality of vanes comprise a first vane group containing first vanes and a second vane group containing second vanes, the second vanes have a length shorter than the first vanes;

the first vanes have substantially the same vane length, and are disposed with gaps established between the first vanes, each of the first vanes draws first trajectory when the classification rotor rotates, first trajectories drawn by the first vanes are substantially same;

the second vanes have substantially the same vane length, and are disposed with gaps established between the second vanes, each of the second vanes draws second trajectory when the classification rotor rotates, second trajectories drawn by the second vanes are substantially same;

the number of second vanes, which are disposed between two adjacent first vanes, is 1 to 2, independently;

a distance from the center of rotation to an outer circumference side end of the first trajectory is defined as L1 for the first trajectory, and a distance from the center of rotation to the center side end of the first trajectory is defined as L2, a distance from the center of rotation to an outer circumference side end of the second trajectory is defined as L3 for the second trajectory, and a distance from the center of rotation to the center side end of the second trajectory is defined as L4, L1 to IA satisfy the following relationships:

$$0.25 \leq (L3-L4)/(L1-L2) \leq 0.50$$

$$0.95 \leq L3/L1 \leq 1.05.$$

When the above classification rotor is used, it is possible to provide a toner classification apparatus which can exhibit an excellent yield while removing a sufficient amount of particles having too small diameter even if the toner has a small particle diameter. The reason for this is inferred by the inventors to be as follows.

The centrifugal force acting on an object is indicated by [mass of object]×[radius of rotation]×[square of angular velocity of rotational motion]. Here, the radius of rotation of the particles to be classified is thought to be a distance between the center of rotation of the classification rotor and the particles to be classified.

In addition, when the classification process is performed, it is thought that a vortex is generated between adjacent vanes of the classification rotor that rotates at a high speed. Since it is thought that the air flow speed is lower toward the center portion of the vortex, and the air flow speed is higher away from the center portion of the vortex, an air flow that is strongly locally drawn inward is generated due to the presence of the vortex, an air flow that is strongly locally drawn inward outweighs the centrifugal force that acts on particles that should inherently not be removed, and in some cases, the particles that inherently should not be removed may also be drawn out and removed.

Since it is inferred that the size of the vortex increases as the gap between adjacent vanes becomes larger, if a total amount of air that passes through the classification rotor is uniform, there are more portions in which an air flow that is strongly drawn inward is generated in the classification rotor as the gap between adjacent vanes becomes larger, and thus there is also a higher likelihood of particles that inherently should not be removed being drawn out, and as a result, the yield decreases.

The classification rotor comprises a plurality of vanes that extend from a side of a center of the classification rotor to an outer circumference side of the classification rotor, the plurality of vanes are disposed with prescribed gaps established between the vanes, and the gaps form an opening connecting a region of the center of rotation of the classification rotor.

In addition, the plurality of vanes comprise a first vane group containing first vanes and a second vane group containing second vanes, and the second vanes have a length shorter than the first vanes.

In addition, the first vanes have substantially the same vane length, and are disposed with gaps established between the first vanes so that substantially the same trajectory is drawn when the classification rotor rotates, and the second vanes have substantially the same vane length, and are disposed with gaps established between the second vanes so that substantially the same trajectory is drawn when the classification rotor rotates.

In addition, the number of second vanes, which are disposed between two adjacent first vanes, is 1 to 2, independently.

Therefore, since the opening inside the classification rotor is formed by two adjacent first vanes, it is thought that an increase in pressure loss and deterioration of performance due to the particles to be classified and particles having too small diameter adhering to the inner side of the classification rotor do not occur for a classification rotor having only the first vane group as vanes. Since the size of the vortex generated when the air flow enters from the outer side of the classification rotor can be smaller than that of the rotor in which there is only the first vane group, the yield can be improved.

In addition, straight vanes that extend linearly from the center of rotation toward the outer circumference are mainly used as vanes included in the first vane group and vanes included in the second vane group.

Here, when it is stated that "substantially the same vane length," this is not limited to the case in which the lengths of the vanes are exactly the same, and also includes the case in which the lengths of the vanes are the same to the extent that the effects of the present disclosure are not impaired. In addition, when it is stated that "substantially the same trajectory is drawn when the classification rotor rotates," this is not limited to the case in which the trajectory is exactly same, and also includes the case in which the trajectory is the same to the extent that the effects of the present disclosure are not impaired.

In addition, when a trajectory drawn by the first vane group when the classification rotor rotates is defined as a first trajectory, a distance from the center of rotation to an outer circumference side end of the first trajectory is defined as L1 for the first trajectory, and a distance from the center of rotation to the center side end of the first trajectory is defined as L2, when a trajectory drawn by the second vane group when the classification rotor rotates is defined as a second trajectory, a distance from the center of rotation to an outer circumference side end of the second trajectory is defined as L3 for the second trajectory, and a distance from the center of rotation to the center side end of the second trajectory is defined as L4, L1 to IA satisfy the following relationships:

$$0.25 \leq (L3-L4)/(L1-L2) \leq 0.50$$

$$0.95 \leq L3/L1 \leq 1.05.$$

In the case of (L3−L4)/(L1−L2)<0.25, the second vane is too short and does not contribute to the generation of the vortex, and the yield is not improved. In addition, in the case of 0.50<(L3−L4)/(L1−L2), the pressure loss increases. (L3−L4)/(L1−L2) is 0.25 or more, and preferably 0.30 or more. In addition, (L3−L4)/(L1−L2) is 0.50 or less, and preferably 0.45 or less. These numerical value ranges can be arbitrarily combined.

In addition, in the case of L3/L1<0.95 or 1.05<L3/L1, since the centrifugal force applied to the particles to be classified having the same mass depends on [radius of rotation]×[square of angular velocity of rotational motion], the radius of rotation varies and the classification accuracy decreases. L3/L1 is 0.95 or more, and preferably 1.00 or more. In addition, L3/L1 is 1.05 or less, and preferably 1.00 or less. These numerical value ranges can be combined arbitrarily.

L1 is not particularly limited and can be appropriately set, and can be, for example, 60 mm to 120 mm, or 70 mm to 100 mm.

L2 is not particularly limited and can be appropriately set, and can be, for example, 20 mm to 100 mm, or 30 mm to 70 mm.

L3 is not particularly limited and can be appropriately set, and can be, for example, 60 mm to 120 mm, or 70 mm to 100 mm.

L4 is not particularly limited and can be appropriately set, can be, for example, 40 mm to 110 mm, or 60 mm to 90 mm.

In addition, in order to make the size of the vortex generated between the vanes uniform, it is preferable that adjacent vanes be disposed with substantially equal gaps from each other. When the gap between vanes is substantially equal, a part in which the gap between vanes is large and a part in which the gap between vanes is small are unlikely to occur, and an increase in pressure loss due to an air flow inside the classification rotor and a narrowed flow path for the particles to be classified, which can be caused by a part in which the gap between vanes is small, and deterioration of performance of the classification rotor due to the particles to be classified and particles having too small diameter adhering to the inner side of the classification rotor are unlikely to occur.

Here, when it is stated that "the gap between vanes is substantially equal," this is not limited to the case in which the gaps between vanes are exactly the same, and also includes the case in which the gaps are equal to the extent that the effects of the present disclosure are not impaired.

In addition, in the case of the classification rotor having a shape in which the flow path becomes narrower toward the center of rotation of the classification rotor, since the air flow drawn inward becomes gradually stronger, large particles that are inadvertently sucked by certain effects have a centrifugal force in the rotation center side of the classification rotor and are unlikely to be discharged to the outside of the classification rotor.

In order to eliminate this concern, it is preferable that the classification rotor satisfy the following (1) or (2).

(1) when the number of second vanes, which are disposed between two adjacent first vanes, is 1, a surface of the second vane on the upstream side in a direction in which the classification rotor rotates is parallel to a surface of the first vane facing the surface and being on the downstream side in a direction in which the classification rotor rotates, and a surface of the second vane on the downstream side in a direction in which the classification rotor rotates is parallel to a surface of the first vane facing the surface and being on the upstream side in a direction in which the classification rotor rotates; and (2) when the number of second vanes, which are disposed between two adjacent first vanes, is 2, if a second vane having a surface facing a surface of the first vane on the downstream side in a direction in which the classification rotor rotates is defined as a second vane A, and a second vane having a surface facing a surface of the second vane A on the downstream side in a direction in which the classification rotor rotates is defined as a second vane B, a surface of the first vane on the downstream side in a direction in which the classification rotor rotates is parallel to a surface of the second vane A facing the surface and being on the upstream side in a direction in which the classification rotor rotates, a surface of the second vane A on the downstream side in a direction in which the classification rotor rotates is parallel to a surface of the second vane B facing the surface and being on the upstream side in a direction in which the classification rotor rotates, and a surface of the second vane B on the downstream side in a direction in which the classification rotor rotates is parallel to a surface of the first vane facing the surface and being on the upstream side in a direction in which the classification rotor rotates.

Figure 2:
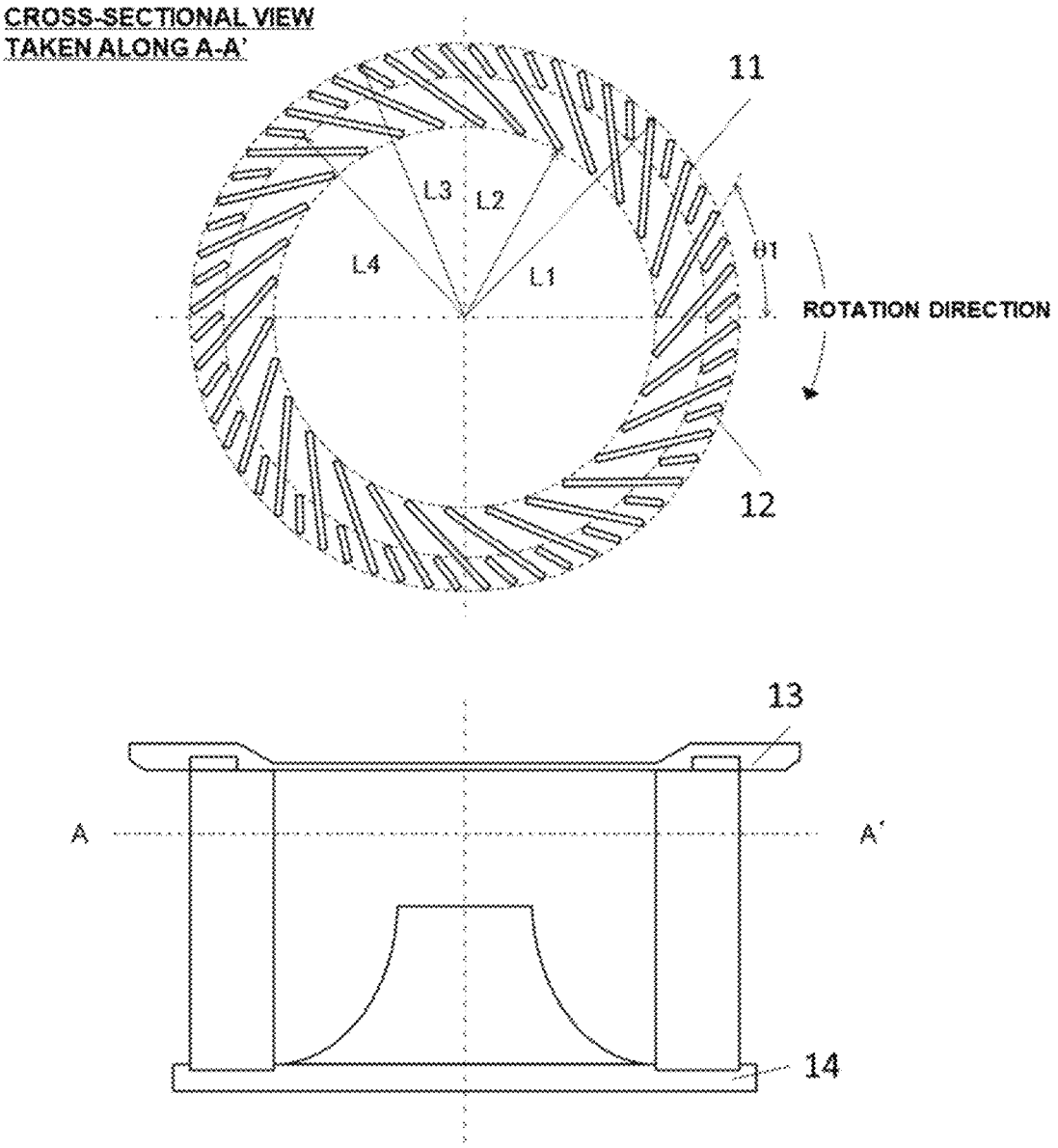
FIG. 2 is a schematic diagram of a classification rotor used in Example 2.
Figure 10:
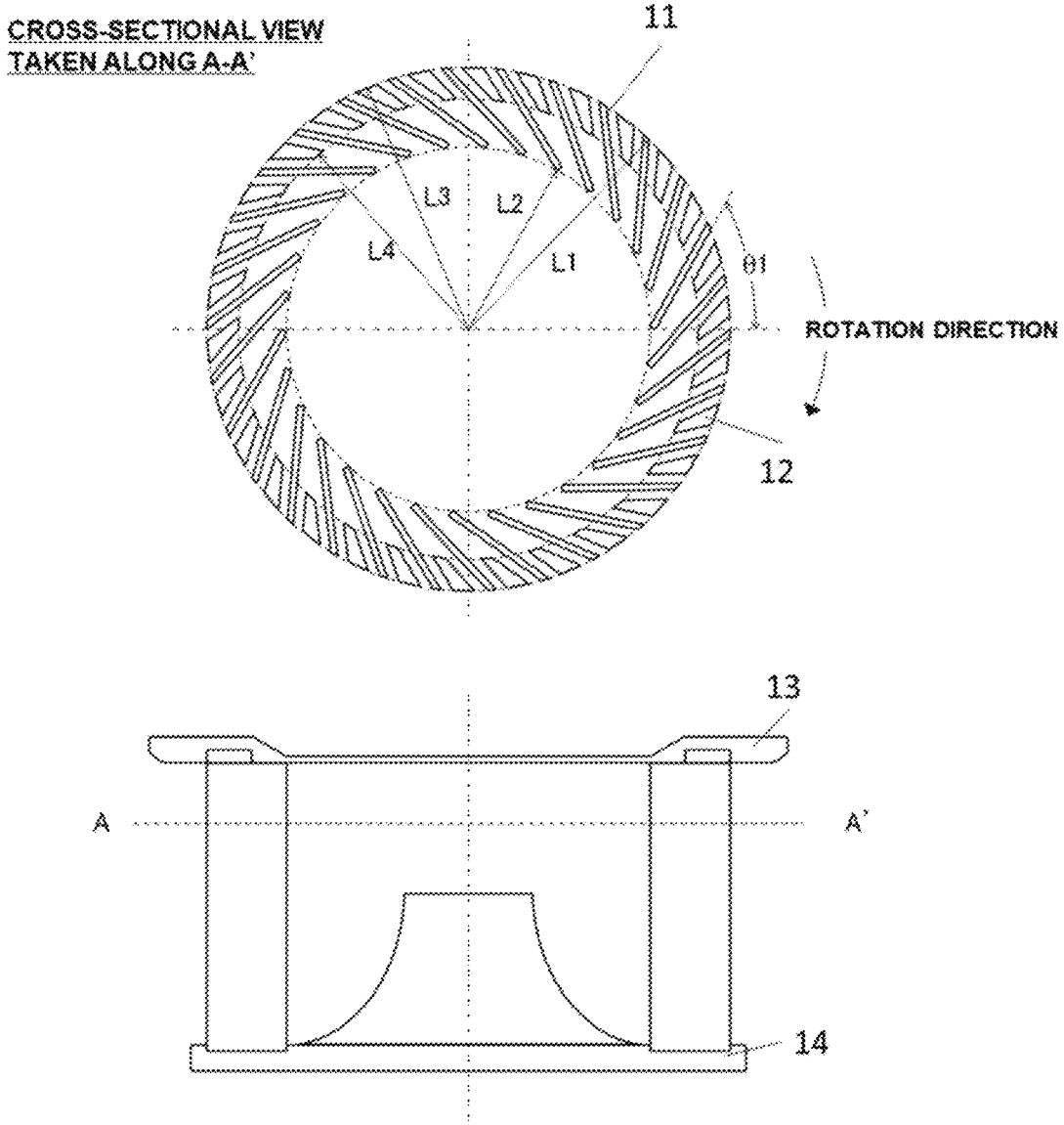
FIG. 10 is a schematic diagram of a classification rotor used in Example 2.
Figure 11:
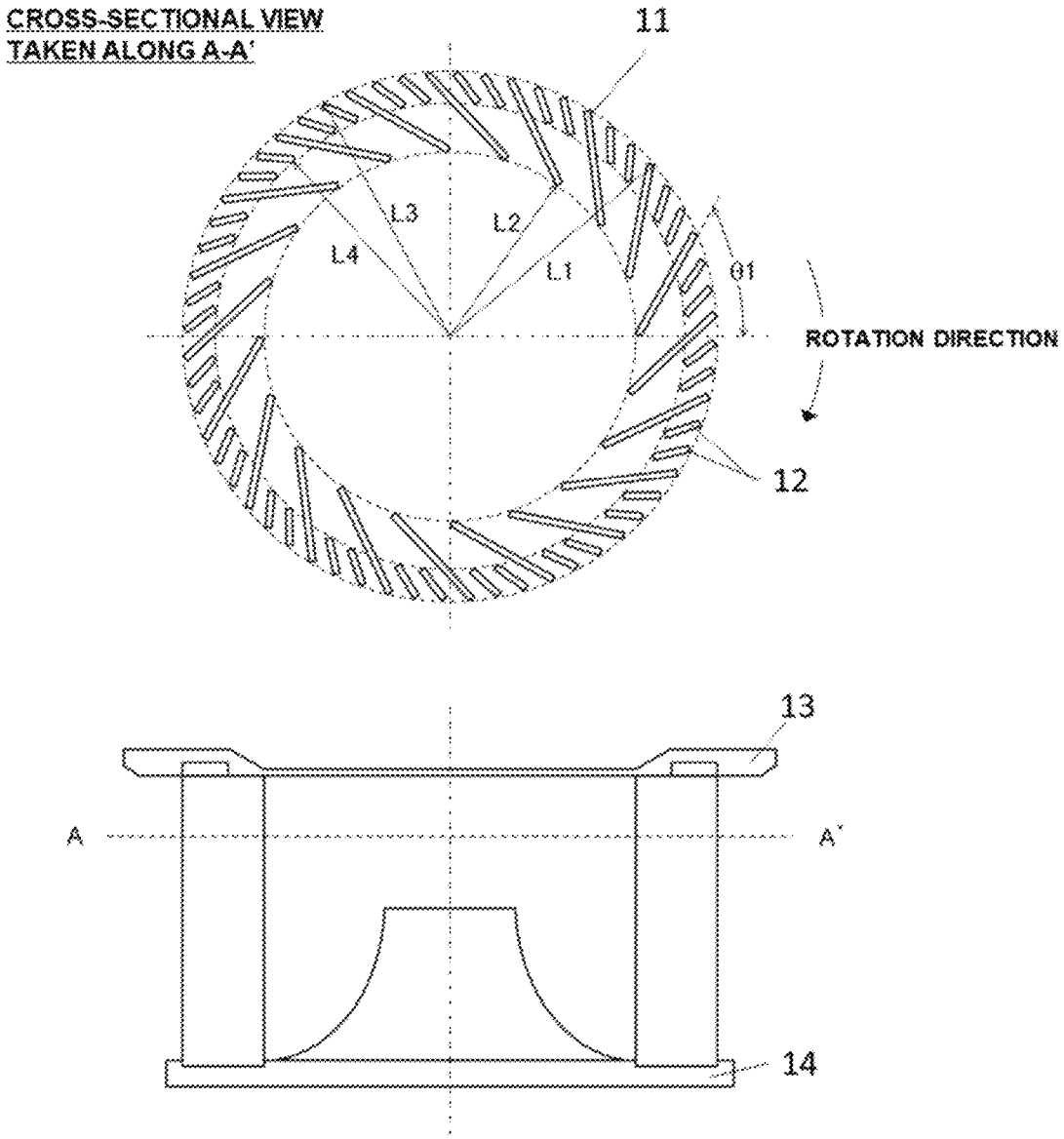
FIG. 11 is a schematic diagram of a classification rotor used in Example 2.

As shown in FIGS. 2, 10, and 11, in a direction perpendicular to the axis of rotation of the classification rotor, in the transverse cross section when the classification rotor is cut away, the classification rotor may form an angle θ which is an acute angle formed by a straight line connecting the center of rotation of the classification rotor and the rotation center side end of the first vane and a straight line connecting the rotation center side end of the first vane and the outer circumference side end of the first vane.

When the angle θ is formed, this is preferable because it is thought that the center position of the vortex that is generated during the classification process can be made to be further outward with respect to the center of rotation of the classification rotor, and even if particles with a large particle diameter are drawn in by the vortex, the centrifugal force does not decrease so that return to the outer side of the classification rotor is possible. In order to exhibit the above effects sufficiently, the formed angle θ is preferably 25° or more and more preferably 30° or more. In addition, the formed angle θ is preferably 70° or less and more preferably 65° or less in order to prevent adverse effects such as an increase in pressure loss due to the distance between the first vanes near the inner end being too small. These numerical value ranges can be arbitrarily combined, and the formed angle θ can be, for example, 25° to 70°.

The means for producing a classification rotor is not particularly limited, and examples thereof include a method of manufacturing parts and assembling them by welding, a method using a metal 3D printer that outputs a structure by melting and coagulating metal powder using laser emission, a die casting method in which a metal mold is produced, and a component obtained by melting a metal such as an aluminum alloy is injected into the metal mold at a high pressure and molding is performed, and a vanishing casting method in which a vanishing model produced by a 3D printer is covered with a refractory, heat is applied from the outside, vanishing in a template is performed, and a metal is poured into the formed cavity portion.

Generally, it is known that production by welding and the die casting method have advantages such as high dimensional accuracy, but have disadvantages such as a long production period, and the method using a metal 3D printer and the vanishing casting method have advantages such as being able to support a complicated shape and a short delivery time, but have disadvantages such as restrictions on the production size. The means for producing a classification rotor may be appropriately selected in consideration of advantages and disadvantages of each production means, and the dimensions, accuracy, delivery time, and the like required for desired classification rotors.

Figure 3:
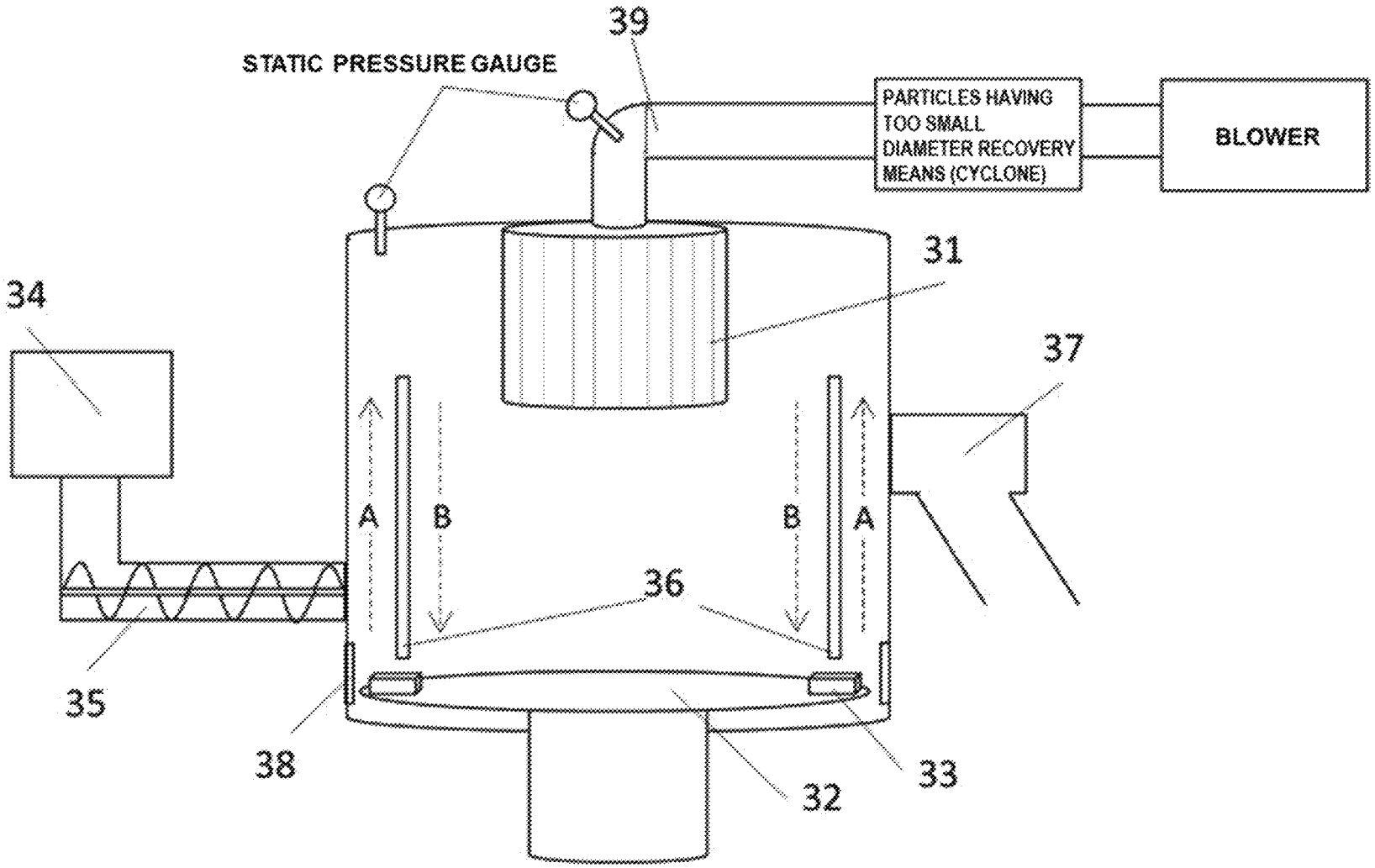
FIG. 3 is a schematic diagram of a toner classification apparatus used in the examples.

The toner classification apparatus should have the classification rotor described above in order to remove the particles having too small diameter in the particles to be classified, but is not otherwise particularly limited, and the main unit of the toner classification apparatus may have, for example, supply means for supplying the particles to be classified, recovery means for the classified material post-classification processing, and so forth. As the particle diameter of the particles to be classified declines, the number of particles per unit mass increases and due to this the number of particle-to-particle contact points increases and aggregates are then more easily formed. From the standpoint of being able to proceed with the classification step while breaking down these aggregates, the toner classification apparatus preferably has, as shown in FIG. 3, a cylindrical body casing;

the aforementioned classification rotor 31;

cylindrical guide means 36 disposed in a state of overlapping at least a portion of the classification rotor;

an introduction port 34 for particles to be classified and supply means 35 for the particles to be classified that has the introduction port 34 for particles to be classified, these being formed in a side surface of the body casing in order to introduce the particles to be classified;

particles having too small diameter discharge port 39 and a classified particle take-off port 37, these being formed in a side surface of the body casing in order to discharge, from the body casing, classified particles from which the particles having too small diameter have been excluded; and a dispersion rotor 32 that is a rotating body attached within the body casing to the central rotational axle and that has a dispersion hammer (for example, a rectangular block) 33 on the side surface of the classification rotor 31 side of the dispersion rotor 32.

The body casing and the guide means 36 are not limited to cylindrical shapes and may assume any shape.

Due to the presence of the guide means 36, an ascending air flow, directed toward the classification rotor 31, is produced in a first space A, and a descending air flow, directed to the side of the dispersion rotor 32, is produced in a second space B. It is thought that this enables the classification process to be carried out while the dispersion hammer 33 breaks up aggregates of the particles to be classified. As long as the dispersion hammer 33 can break up aggregates of the particles to be classified, it is not otherwise limited to a rectangular block and may assume any shape.

Moreover, from the standpoint of being able to improve the flowability by raising the average circularity of the toner, more preferably a liner 38 is disposed in a fixed manner at the circumference of the dispersion rotor 32 while maintaining a distance therefrom. The liner 38 is preferably provided with grooves in the surface that faces the dispersion rotor 32.

It is thought that when the particles to be classified undergo impact with, e.g., the rotating dispersion hammers and the surface of the liner facing the dispersion hammers, protruded portions on the particles to be classified are flattened and the average circularity is raised as a result. When the efficiency of removing particles having too small diameter during classification is low, the average circularity-improving effect on the particles may be reduced—due to the persistence of a condition in which a large number of particles to be classified are present within the casing—as compared to that when the efficiency of removing particles having too small diameter is high.

The height of the vane of the classification rotor is not particularly limited, and can be appropriately set according to the dimensions of the classification rotor and the classification apparatus, the amount of particles to be treated, and the like, and can be, for example, 50 mm to 100 mm.

In addition, a total number of vanes of the classification rotor (a sum of the number of first vanes and the number of second vanes) is not particularly limited, and can be appropriately set according to the dimensions of the classification rotor and the classification apparatus, the amount of particles to be treated, and the like, and can be, for example, 50 to 100. The number of first vanes of the classification rotor is not particularly limited, and can be appropriately set according to the dimensions of the classification rotor and the classification apparatus, the amount of particles to be treated, and the like, and can be, for example, 10 to 40. The number of second vanes of the classification rotor is not particularly limited, and can be appropriately set according to the dimensions of the classification rotor and the classification apparatus, the amount of particles to be treated, and the like, and can be, for example, 20 to 50.

In addition, the gap between vanes disposed in the classification rotor is not particularly limited as long as the opening connecting the rotation center region of the classification rotor is formed, and can be appropriately set according to the dimensions of the classification rotor and the classification apparatus, the amount of particles to be treated, and the like. For example, the gap between vanes that are disposed adjacent to each other at the outer circumference side end of the classification rotor can be 5 mm to 10 mm.

The diameter of the classification rotor is not particularly limited, and can be appropriately set according to the dimensions of the classification apparatus, the amount of particles to be treated, and the like, and can be, for example, 60 mm to 120 mm.

In addition, the dimensions such as the height and inner diameter of the body casing in the classification apparatus are not particularly limited, and can be appropriately set according to the dimensions of the classification rotor, the amount of particles to be treated, and the like. The height of the body casing can be, for example, 150 mm to 500 mm. In addition, a body casing having an inner diameter of, for example, 150 mm to 500 mm, can be used as the body casing in the classification apparatus of the present disclosure.

The toner classification apparatus may be applied to the powder particles provided by known production methods, e.g., the melt-kneading/pulverization method, suspension polymerization method, emulsion aggregation method, dissolution suspension method, and so forth, but is advantageously used in particular in the melt-kneading/pulverization method in view of the ease of production of particles having too small diameter when smaller toner particle diameters are sought. A procedure for producing toner by the melt-kneading/pulverization method is described in the following, but there is no limitation to or by the following procedure.

Toner Particle Production Method

First, in a starting material mixing step, at least a binder resin is weighed out in prescribed amounts as the toner starting material and is blended and mixed. The following, for example, may also be admixed as necessary: colorant, a release agent that suppresses the occurrence of hot offset when the toner is heated and fixed, a dispersing agent that disperses the release agent, a charge control agent, and so forth. The mixing apparatus can be exemplified by the double cone mixer, V-mixer, drum mixer, Super mixer, Henschel mixer, and Nauta mixer.

Then, in a melt-kneading step, the toner starting materials blended and mixed in the starting material mixing step are melt-kneaded and the resins are melted and the colorant and so forth are dispersed therein. For example, a batch kneader, e.g., a pressure kneader, Banbury mixer, and so forth, or a continuous kneader can be used in this melt-kneading step. Single-screw and twin-screw extruders have become the main stream in recent years because they offer the advantages of, e.g., enabling continuous production, and, for example, a Model KTK twin-screw extruder from Kobe Steel, Ltd., a Model TEM twin-screw extruder from Toshiba Machine Co., Ltd., a twin-screw extruder from KCK, a Co-Kneader from Buss AG, and so forth are commonly used.

After melt-kneading, the melt-kneaded material provided by melting-kneading the toner starting materials is rolled out using, for example, a two-roll mill, and cooled in a cooling step of cooling by, for example, water cooling.

The cooled melt-kneaded material provided by the cooling step is then pulverized to a desired particle diameter in a pulverization step. A coarse pulverization with, e.g., a crusher, hammer mill, feather mill, and so forth, is first carried out in the pulverization step. A finely pulverized material is then obtained by carrying out a fine pulverization using a mechanical pulverizer, e.g., Inomizer (Hosokawa Micron Corporation), Kryptron (Kawasaki Heavy Industries, Ltd.), Super Rotor (Nisshin Engineering Inc.), Turbo Mill (Turbo Kogyo Co., Ltd.), and so forth. Such a stagewise pulverization is performed in the pulverization step to the prescribed toner particle size.

Using the pulverized material provided by the pulverization step as the particles to be classified, a toner particle is obtained by carrying out a classification process (classification step), using the toner classification apparatus, on the particles to be classified.

The obtained toner particle may be used as such as toner, but, in order to provide functionalities required of toner, may be made into toner optionally by the addition of inorganic fine particles, e.g., silica, to the toner particle, followed by, e.g., the execution of a thermal spheronizing treatment.

In order to support an improved toner transferability, the average circularity of the toner is preferably at least 0.955 and is more preferably at least 0.960. The average circularity is preferably not more than 0.990 based on a consideration of preventing poor cleaning.

In addition, the weight-average particle diameter of the toner is preferably a small particle diameter from the standpoint of increasing the image quality of the image formed by the toner, and specifically from 3.00 μm to 6.00 μm is preferred and from 3.00 μm to 5.00 μm is more preferred. While small weight-average particle diameters are preferred for the toner, values of at least 3.00 μm largely prevent this parameter from contributing to image defects due to escape past the cleaning vane.

The number % of 3 μm or less in the toner is preferably not more than 20.0 number %, more preferably not more than 15.0 number %, and still more preferably not more than 10.0 number %.

Toner Starting Materials

The starting materials are described in the following for a toner that contains at least a binder resin.

Binder Resin

Common resins can be used for the binder resin, for example, polyester resins, styrene-acrylic acid copolymers, polyolefin resins, vinyl resins, fluororesins, phenolic resins, silicone resins, and epoxy resins. Among the preceding, amorphous polyester resins are preferred from the standpoint of providing a good low-temperature fixability. The combination of a low molecular weight polyester resin with a high molecular weight polyester resin may be used based on a consideration of the coexistence of the low-temperature fixability with the hot offset resistance.

Viewed from the standpoint of the blocking resistance during storage and obtaining additional improvements in the low-temperature fixability, a crystalline polyester resin may also be used as a plasticizer.

Colorant

The toner starting materials can include a colorant. The following are examples of colorants that can be included in the toner starting materials.

The colorant can be exemplified by known organic pigments and oil-based dyes, carbon black, magnetic bodies, and so forth.

Cyan colorants can be exemplified by copper phthalocyanine compounds and derivatives thereof, anthraquinone compounds, and basic dye lake compounds.

Magenta colorants can be exemplified by condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

Yellow colorants can be exemplified by condensed azo compounds, isoindolinone compounds, anthraquinone compounds, azo-metal complexes, methine compounds, and allylamide compounds.

Black colorants can be exemplified by carbon black and magnetic bodies and by black colorants provided by color mixing using the aforementioned yellow colorants, magenta colorants, and cyan colorants to give a black color.

The colorants may be used alone or two or more thereof may be used in combination.

Release Agent

A release agent may be used on an optional basis to suppress the appearance of hot offset when the toner is heated and fixed. This release agent can be generally exemplified by low molecular weight polyolefins, silicone waxes, fatty acid amides, ester waxes, carnauba wax, and hydrocarbon waxes.

The methods used to measure the various properties of the starting materials and toner are described in the following.

Method for Measuring the Weight-Average Particle Diameter (D4) of the Toner

The weight-average particle diameter (D4) of the toner is determined by carrying out the measurements in 25,000 channels for the number of effective measurement channels and performing analysis of the measurement data using a "Coulter Counter Multisizer 3" (registered trademark, Beckman Coulter, Inc.), a precision particle size distribution measurement instrument operating on the pore electrical resistance method and equipped with a 100 μm aperture tube, and using the accompanying dedicated software, i.e., "Beckman Coulter Multisizer 3 Version 3.51" (Beckman Coulter, Inc.) to set the measurement conditions and analyze the measurement data.

The aqueous electrolyte solution used for the measurements is prepared by dissolving special-grade sodium chloride in deionized water to provide a concentration of approximately 1 mass % and, for example, "ISOTON II" (Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the threshold value/noise level measurement button. In addition, the current is set to 1600 μA; the gain is set to 2; the electrolyte solution is set to ISOTON II; and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm.

The specific measurement procedure is as follows.

(1) Approximately 200 mL of the above-described aqueous electrolyte solution is introduced into a 250 mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture tube flush" function of the analysis software.

(2) Approximately 30 mL of the aqueous electrolyte solution is introduced into a 100 mL flatbottom glass beaker, and to this is added as dispersing agent approximately 0.3 mL of a dilution prepared by the three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) A prescribed amount of deionized water is introduced into the water tank of an "Ultrasonic Dispersion System Tetora 150" (Nikkaki Bios Co., Ltd.), an ultrasound disperser having an electrical output of 120 W and equipped with two oscillators (oscillation frequency=50 kHz) disposed such that the phases are displaced by 180°, and approximately 2 mL of Contaminon N is added to the water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be from 10° C. to 40° C.

(6) Using a pipette, the dispersed toner-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4).

Method for Measuring the Number % of 3 μm or Less in the Toner

When set to graph/number % with the dedicated software in step (7) in the method for measuring the weight-average particle diameter (D4) of the toner, the cumulative value for the number % in the particle diameter region of 3 μm or less is the number % of 3 μm or less.

Method for Measuring the Average Circularity

The average circularity of the toner is measured using an "FPIA-3000" (Sysmex Corporation), a flow particle image analyzer, and using the measurement and analysis conditions from the calibration process.

The specific measurement procedure is as follows. First, approximately 20 mL of deionized water—from which, e.g., solid impurities have been removed in advance—is introduced into a glass vessel. To this is added as dispersing agent approximately 0.2 mL of a dilution prepared by the approximately three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.). Approximately 0.02 g of the measurement sample is added and a dispersion treatment is carried out for 2 minutes using an ultrasound disperser to provide a dispersion to be used for the measurement. Cooling is carried out as appropriate during this process in order to have the temperature of the dispersion be from 10° C. to 40° C. Using a benchtop ultrasound cleaner/disperser that has an oscillation frequency of 50 kHz and an electrical output of 150 W ("VS-150" (Velvo-Clear Co., Ltd.)) as the ultrasound disperser, a prescribed amount of deionized water is introduced into the water tank and approximately 2 mL of Contaminon N is added to the water tank.

The previously cited flow particle image analyzer fitted with an objective lens (10×) was used for the measurement, and "PSE-900A" (Sysmex Corporation) particle sheath was used for the sheath solution. The dispersion adjusted according to the procedure described above is introduced into the flow particle image analyzer and 3,000 toner particles are measured according to total count mode in HPF measurement mode. The average circularity of the toner particle is determined with the binarization threshold value during particle analysis set at 85% and the analyzed particle diameter limited to a circle-equivalent diameter of from 1.985 μm to less than 39.69 μm.

For this measurement, automatic focal point adjustment is performed prior to the start of the measurement using reference latex particles (a dilution with deionized water of "RESEARCH AND TEST PARTICLES Latex Microsphere Suspensions 5200A", Duke Scientific Corporation). After this, focal point adjustment is preferably performed every two hours after the start of measurement.

In the examples in the present application, the flow particle image analyzer used had been calibrated by the Sysmex Corporation and had been issued a calibration certificate by the Sysmex Corporation. The measurements were carried out using the measurement and analysis conditions when the calibration certification was received, with the exception that the analyzed particle diameter was limited to a circle-equivalent diameter of from 1.985 μm to less than 39.69 μm.

EXAMPLES

The present disclosure is described in additional detail in the following using examples and comparative examples, but these do not limit the embodiments according to the present disclosure. Unless specifically indicated otherwise, the number of parts given in the following in the examples and comparative examples are on a mass basis in all instances.

Binder Resin Production Example polyoxypropylene(2.2)-2,2-bis(4-hydroxyphenyl)propane: 72.0 parts (100 mol % with reference to the total number of moles of polyhydric alcohol)

terephthalic acid: 28.0 parts (96 mol % with reference to the total number of moles of polybasic carboxylic acid)

tin 2-ethylhexanoate (esterification catalyst): 0.5 parts

These materials were metered into a reactor equipped with a condenser, stirrer, nitrogen introduction line, and thermocouple. The interior of the flask was then substituted with nitrogen gas, the temperature was subsequently gradually raised while stirring, and a reaction was run for 8 hours while stirring at a temperature of 220° C. The pressure in the reactor was then reduced to 8.3 kPa, holding was carried out for 1 hour, cooling to 180° C. was thereafter implemented, and return to atmospheric pressure was carried out.

trimellitic anhydride: 1.3 parts (4 mol % with reference to the total number of moles of polybasic carboxylic acid)

tert-butylcatechol (polymerization inhibitor): 0.1 parts

These materials were subsequently added, the pressure in the reactor was dropped to 8.3 kPa, and a reaction was run for 1 hour while maintaining a temperature of 180° C. to obtain a binder resin (amorphous polyester resin). The softening point of the resulting binder resin, as measured in accordance with ASTM D 36-86, was 110° C.

Example of Production of Pulverized Particle for Toner (Particles to be Classified)

binder resin 86 parts

Fischer-Tropsch wax (hydrocarbon wax, melting point=90° C.) 7 parts

C.I. Pigment Blue 15:3 7 parts

These materials were mixed using a Henschel mixer (Model FM-75, Mitsui Mining Co., Ltd.) at a rotation rate of 20 $s^{-1}$ and a rotation time of 5 minutes, and were then kneaded with a twin-screw kneader (Model PCM-30, Ikegai Corporation). The barrel temperature during kneading was set so as to provide an outlet temperature for the kneadate of 120° C. The outlet temperature of the kneadate was directly measured using an HA-200E handheld thermometer from Anritsu Meter Co., Ltd. The resulting kneadate was cooled and coarsely pulverized using a hammer mill to a volume-average particle diameter of not greater than 100 μm to provide a coarsely pulverized material.

Finely pulverized material 1 was obtained by subjecting this coarsely pulverized material to pulverization using a mechanical pulverizer (Turbo Mill T250-CRS, rotor configuration: RS type, from Turbo Kogyo Co., Ltd.) and conditions of a rotor rotation rate of 11,000 rpm and a pulverization feed of 10 Kg/h. In addition, the finely pulverized material 1 was pulverized under conditions of a rotor rotation speed of 11,000 rpm and a pulverization feed of 10 Kg/h to obtain pulverized particle 1 for toner (particle 1 to be classified). The weight-average particle diameter of the pulverized particle 1 for toner was 5.45 μm, the percentage which were 3 μm or less was 34.2%, and the average circularity was 0.950.

In addition, finely pulverized material 2 was obtained by subjecting the coarsely pulverized material to pulverization using conditions of a rotor rotation rate of 12,000 rpm and a pulverization feed of 12 Kg/h. In addition, pulverized particle 2 for toner (particle 2 to be classified) was obtained by subjecting the finely pulverized material 2 to additional pulverization using conditions of a rotor rotation rate of 12,000 rpm and a pulverization feed of 12 Kg/h. The pulverized particle 2 for toner had a weight-average particle diameter of 4.50 μm, a number % of 3 μm or less of 41.2%, and an average circularity of 0.952.

Toner Classification Apparatus

The toner classification apparatus shown in FIG. 3 was used for the structure of the toner classification apparatus. This toner classification apparatus is constituted of the following:

a cylindrical body casing;

a disk-shaped dispersion rotor 32 that rotates at high speed and is a rotating body attached in the body casing to a central rotational axle, and that has a plurality of dispersion hammers 33 on the side surface of the rotating body on the classification rotor side;

a liner 38 that is disposed at the circumference of the dispersion rotor 32 while maintaining a distance therefrom;

a classification rotor 31, which is means for the classification of particles to be classified;

particles having too small diameter discharge port 39 for the discharge and removal of particles of not more than a prescribed particle diameter and selected by the classification rotor 31;

a cooling wind introduction port (not shown) for the introduction of a cooling wind from below the dispersion rotor;

an introduction port 34 for the particles to be classified and supply means 35 for the particles to be classified that has the introduction port 34 for the particles to be classified, for the introduction of the particles to be classified into the interior of the body casing;

a classified particle take-off port 37 for discharging the classified particles after the classification process; and cylindrical guide means 36 disposed in a state of overlapping at least a portion of the classification rotor 31.

The guide means 36 partitions the space of the body casing in the toner classification apparatus into a space A, where an air current is produced in a direction that introduces the particles to be processed to the classification rotor 31, and a space B, where an air current is produced in the direction that introduces the particles to be processed to between the dispersion rotor 32 and the liner 38.

In addition, particles having too small diameter discharge port 39 communicated with particles having too small diameter recovery means (cyclone) 40 for recovering the discharged particles having too small diameter, and was connected to a blower 41 that communicated with particles having too small diameter recovery means 40. An air flow from the outer side to the inner side of the classification rotor 31 could be generated using the blower 41. In addition, a static pressure gauge 42 for measuring the pressure inside the body casing (the static pressure on the inlet side of the classification apparatus) and the pressure in particles having too small diameter discharge port portion (the static pressure on the outlet side of the classification apparatus) was installed.

Under conditions in which only the shape of the classification rotor was different and classification conditions such as the blower air volume and the rotor rotation speed were the same, if the A static pressure in front of and behind the classification apparatus was low, the pressure loss specific to the classification rotor could be considered low. When the pressure loss due to the classification apparatus was small, this was preferable because the load on the blower when the air volume required for classification was output could be reduced to a low level.

Figure 4:
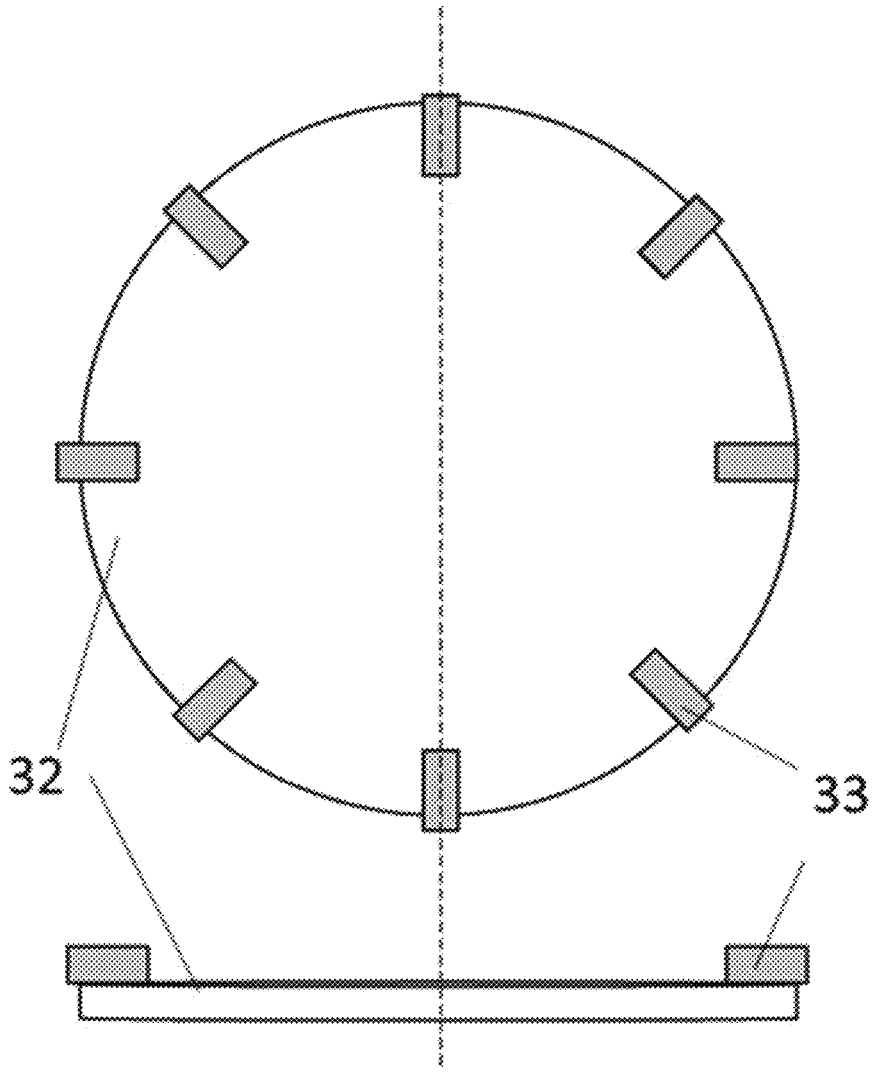
FIG. 4 is a schematic diagram of a dispersion rotor used in the examples.

The height of the space in the body casing was 300 mm and the internal diameter was 300 mm. The outer diameter of the dispersion rotor was 285 mm, eight dispersion hammers were attached on the dispersion rotor as shown in FIG. 4, and the length/width/height of each dispersion hammer was 30 mm/20 mm/20 mm.

Figure 5:
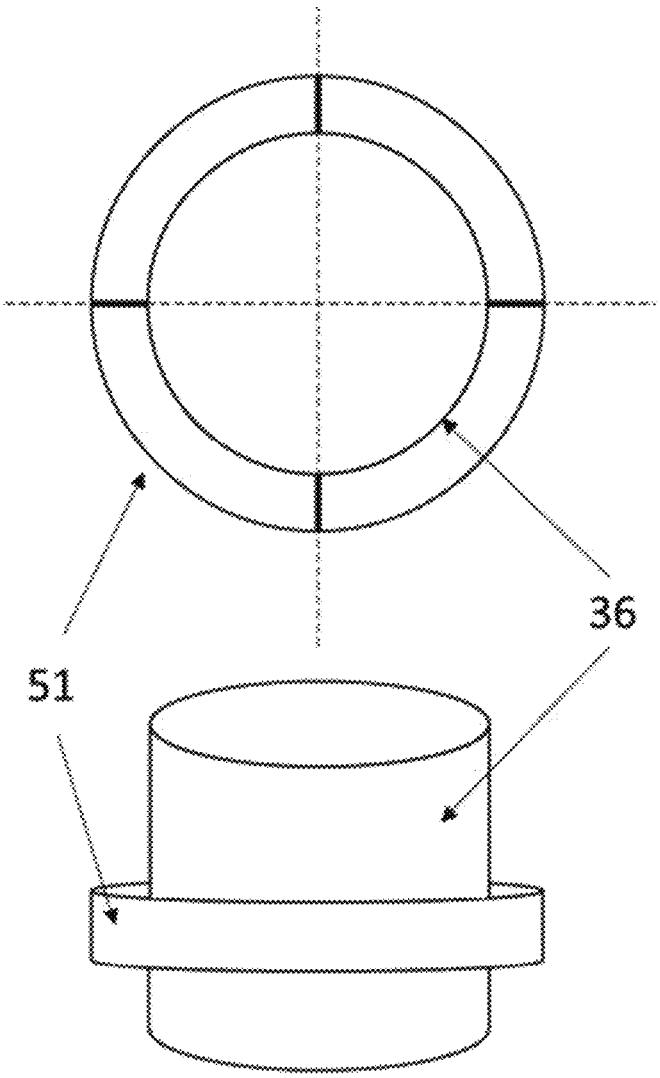
FIG. 5 is a schematic diagram of guide means used in the examples.

As shown in FIG. 5, the cylindrical guide means was connected to a guide means support member 51 and could be installed at any position by connecting the guide means support member to the body casing using, e.g., screws. The diameter of the guide means was 250 mm and its height was 230 mm, and the distance between the upper end of the guide means and the upper end of the casing was 20 mm.

Liner

Figure 6:
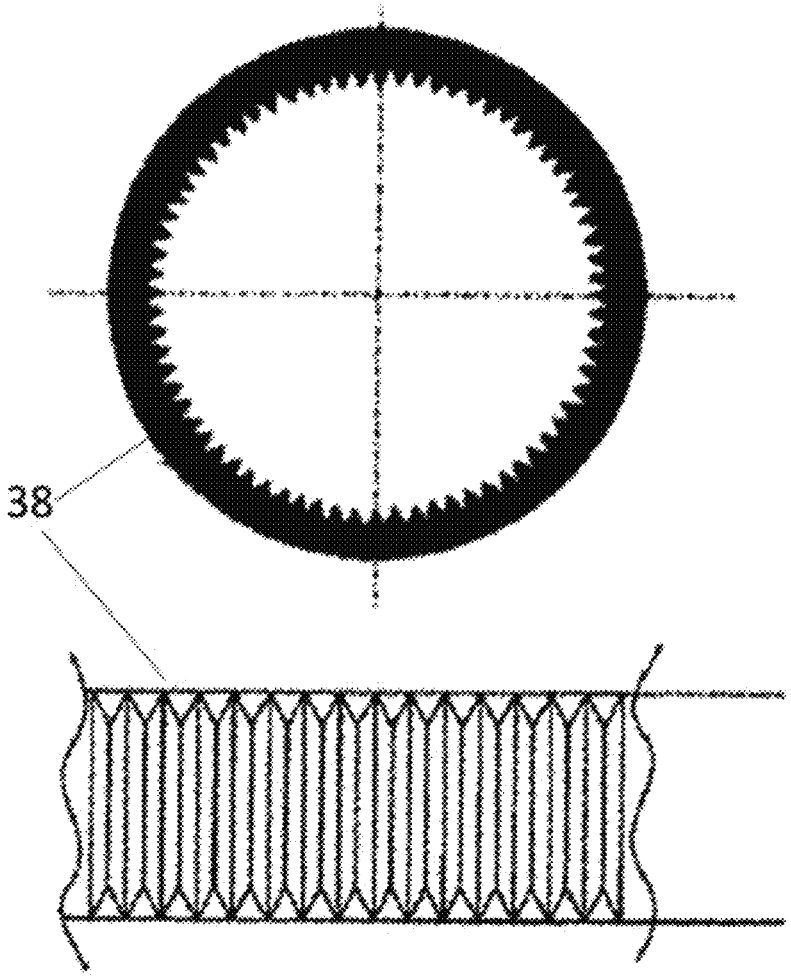
FIG. 6 is a schematic diagram of a liner used in the examples.

Liner 1 had a plurality of protruding portions as shown in FIG. 6 and depressed portions formed between a protruding portion and another protruding portion, and the shape of the unevenness was a triangular shape, the repeating distance between a protruding portion and another protruding portion was 3 mm, the depth h of the depressed portion was 3.0 mm, and the height of the liner was 50 mm. As Liner 2, a liner having a smooth surface obtained by removing the uneven surface of Liner 1 was used.

Classification Rotors 1-1 to 1-10 used in Example 1

Classification Rotor 1-1 used in Example 1 had a shape as shown in FIG. 1. One vane included in the second vane group was disposed between two adjacent vanes included in the first vane group. L1 was 82 mm, L2 was 57 mm, L3 was 82 mm, L4 was 70 mm, and the height of the opening of the classification rotor was 88 mm.

In addition, Table 1 shows parts of Classification Rotor 1-2 to Classification Rotor 1-5 that were different from Classification Rotor 1-1.

Figure 7:
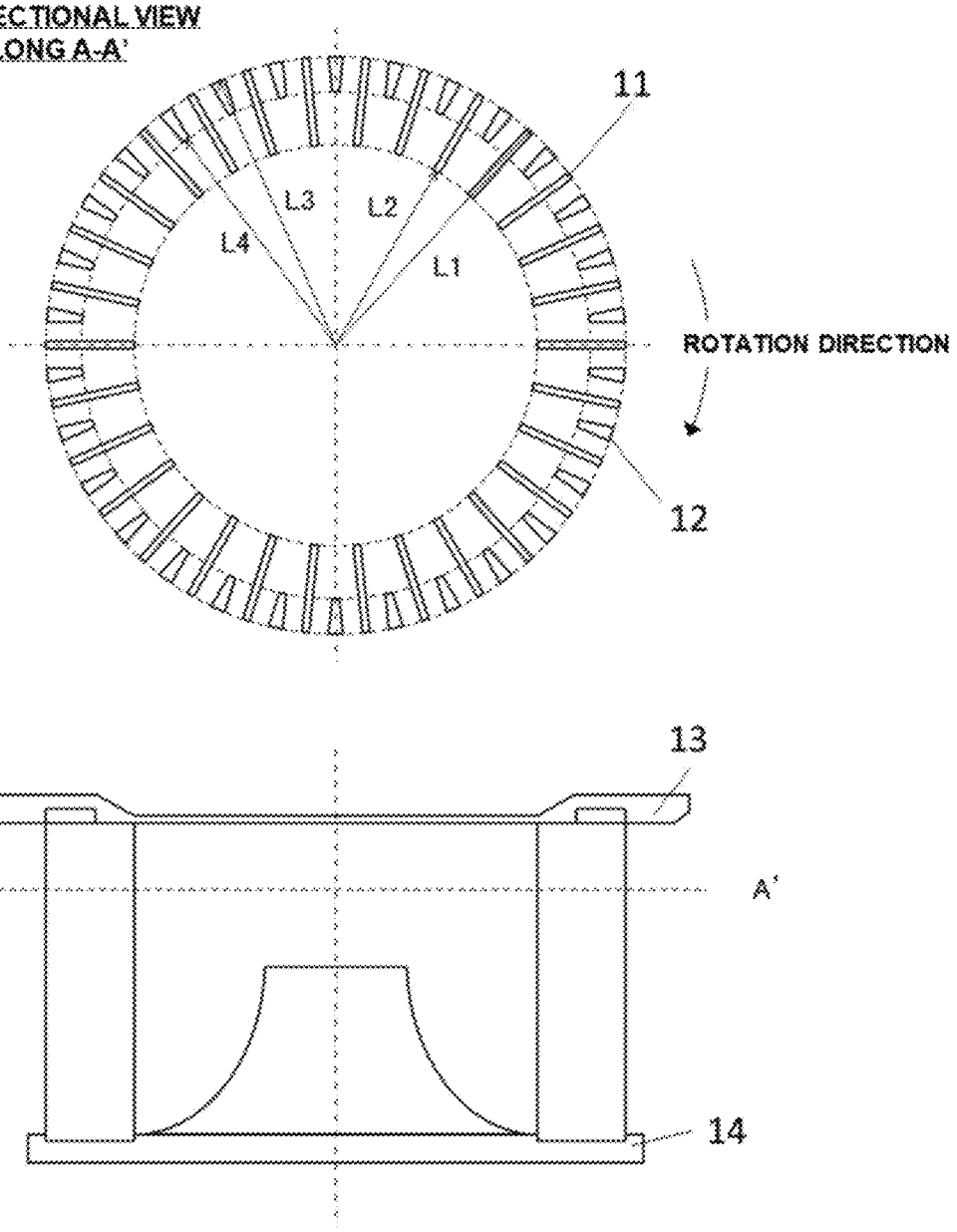
FIG. 7 is a schematic diagram of a classification rotor used in Example 1.

Classification Rotor 1-6 had a shape as shown in FIG. 7. The shape of the vanes included in the second vane group was adjusted so that the thickness on the outer side of the classification rotor was larger than the thickness on the inner side of the classification rotor, and the vanes were adjusted so that opposing surfaces of the vanes were parallel to each other.

Figure 8:
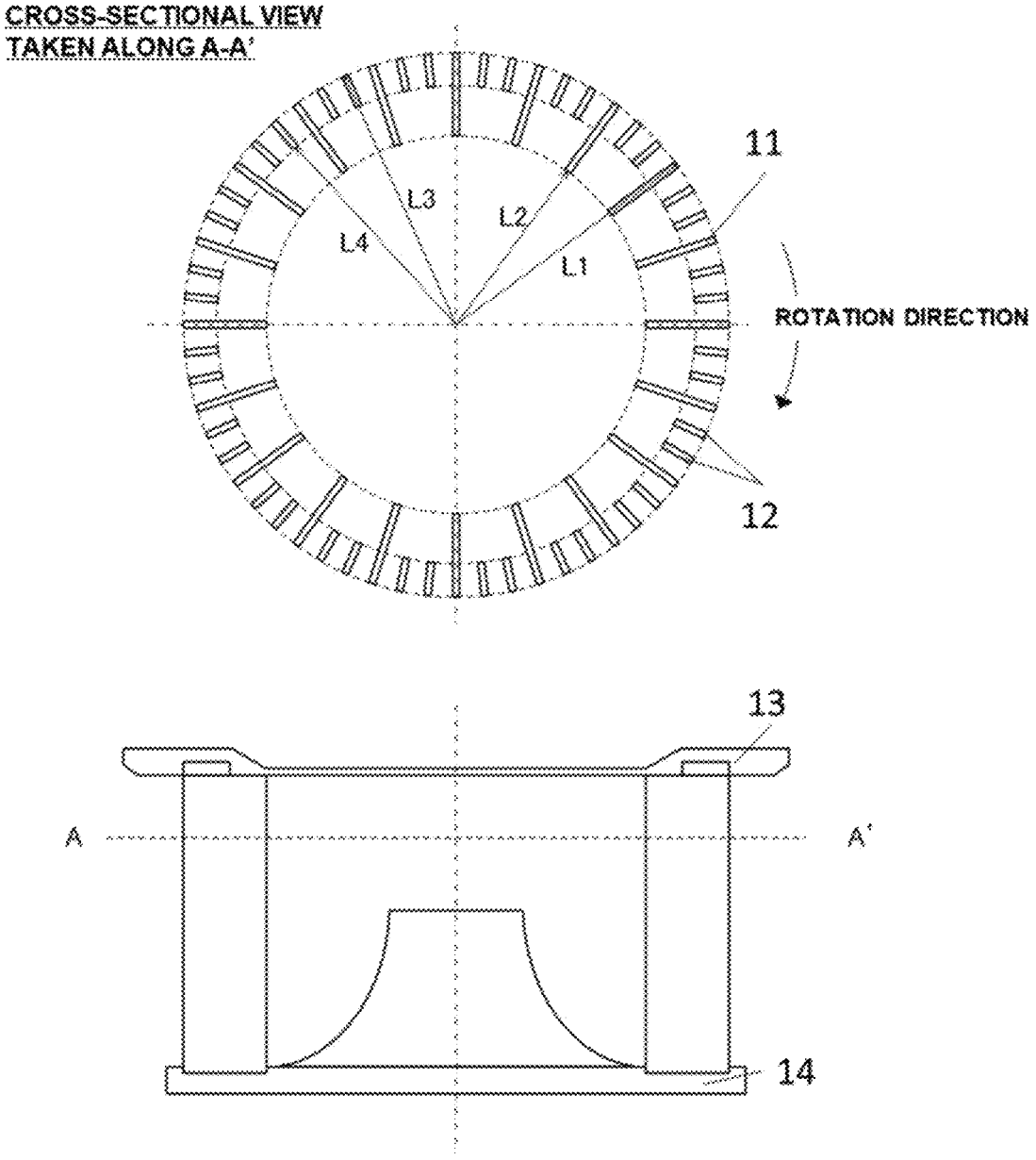
FIG. 8 is a schematic diagram of a classification rotor used in Example 1.

Classification Rotor 1-7 had a shape as shown in FIG. 8. Two vanes included in the second vane group were disposed between two adjacent vanes included in the first vane group. L1 was 82 mm, L2 was 57 mm, L3 was 82 mm, L4 was 70 mm, and the height of the opening of the classification rotor was 88 mm. In addition, Table 1 shows parts of Classification Rotors 1-8 and 1-9 that were different from Classification Rotor 1-7.

Figure 13:
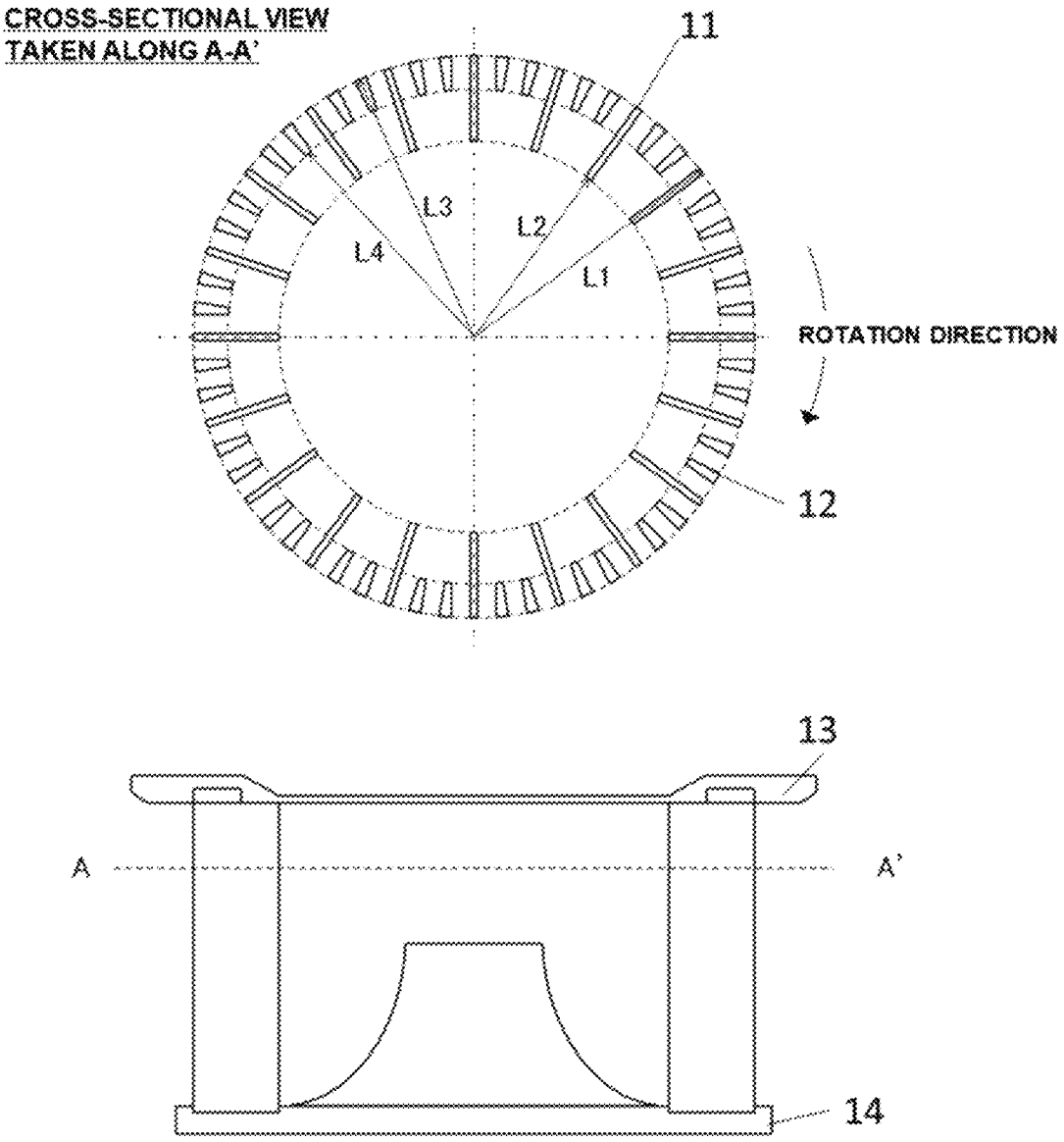
FIG. 13 is a schematic diagram of a classification rotor used in Example 1.

Classification Rotor 1-10 had a shape as shown in FIG. 13. Regarding Classification Rotor 1-10, Classification Rotor 1-8 was adjusted so that, for the vanes included in the shape of the second vane group, the thickness on the outer side of the classification rotor was larger than the thickness on the inner side of the classification rotor, and opposing surfaces of the vanes were parallel to each other.

Comparative Rotors 1-1 to 1-9 used in Comparative Example 1

Figure 9:
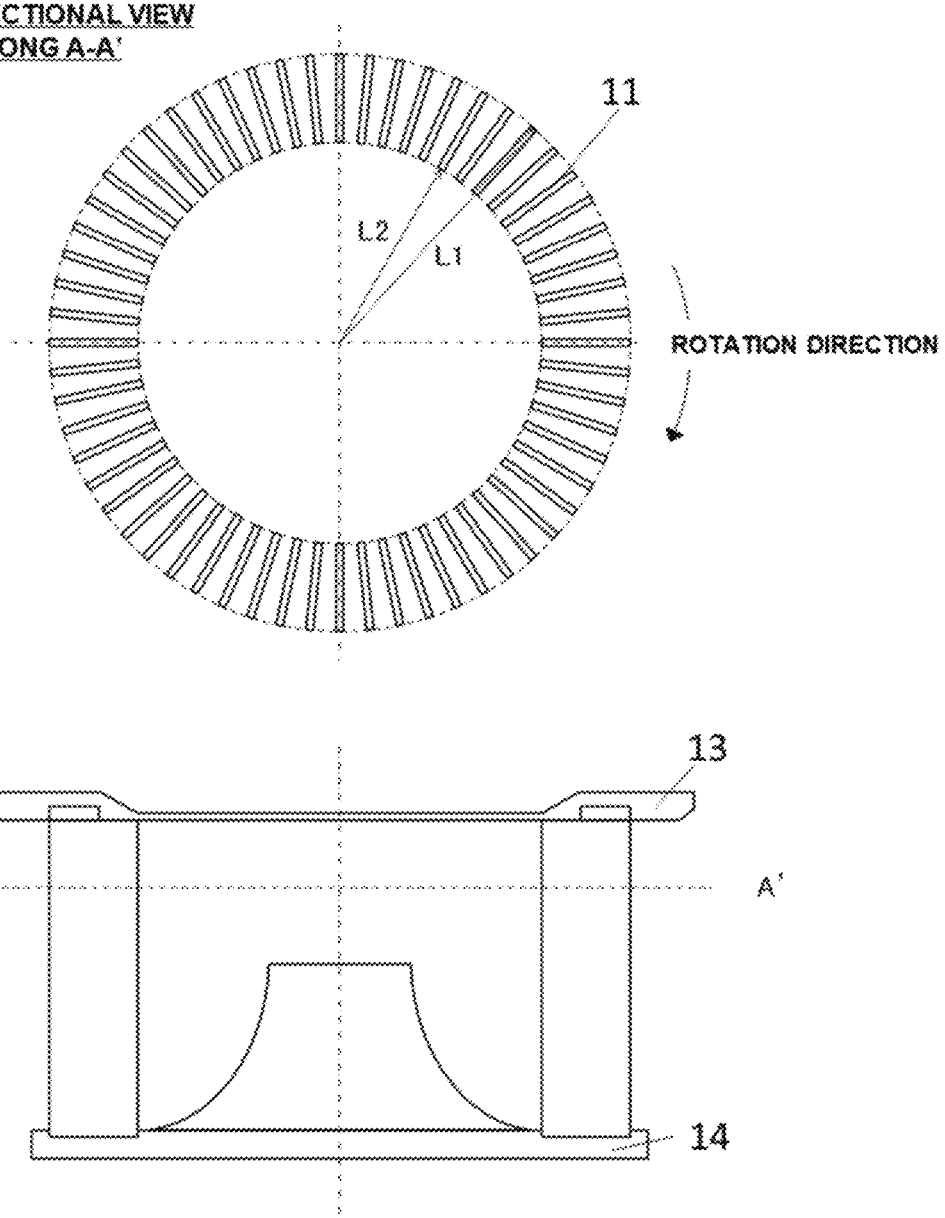
FIG. 9 is a schematic diagram of a classification rotor used in Comparative Example 1.

Comparative Rotor 1-1 used in Comparative Example 1 had a shape as shown in FIG. 9, L1 was 82 mm, L2 was 57 mm, and the height of the opening of the classification rotor was 88 mm.

Table 1 shows parts of Comparative Rotors 1-2 and 1-3 that were different from Comparative Rotor 1-1.

In addition, Table 1 shows parts of Comparative Rotors 1-4 to 1-7 that were different from Classification Rotor 1-1.

Table 1 shows parts of Comparative Rotors 1-8 and 1-9 that were different from Classification Rotor 1-7.

TABLE 1

Table 1

| | Total number of vanes | Number of first vanes | Number of second vanes | L1 (mm) | L2 (mm) | L3 (mm) | L4 (mm) | (L3-L4)/(L1-L2) | L3/L1 | Surfaces of adjacent vanes that face each other |
|---|---|---|---|---|---|---|---|---|---|---|
| Classification Rotor 1-1 | 60 | 30 | 30 | 82 | 57 | 82 | 70 | 0.48 | 1.00 | — |
| Classification Rotor 1-2 | 60 | 30 | 30 | 82 | 57 | 82 | 73 | 0.36 | 1.00 | — |
| Classification Rotor 1-3 | 60 | 30 | 30 | 82 | 57 | 82 | 75 | 0.28 | 1.00 | — |
| Classification Rotor 1-4 | 60 | 30 | 30 | 85 | 60 | 82 | 70 | 0.48 | 0.96 | — |
| Classification Rotor 1-5 | 60 | 30 | 30 | 82 | 57 | 85 | 78 | 0.28 | 1.04 | — |
| Classification Rotor 1-6 | 60 | 30 | 30 | 82 | 57 | 82 | 73 | 0.36 | 1.00 | Parallel |
| Classification Rotor 1-7 | 60 | 20 | 40 | 82 | 57 | 82 | 70 | 0.48 | 1.00 | — |
| Classification Rotor 1-8 | 60 | 20 | 40 | 82 | 57 | 82 | 73 | 0.36 | 1.00 | — |
| Classification Rotor 1-9 | 60 | 20 | 40 | 82 | 57 | 82 | 75 | 0.28 | 1.00 | — |
| Classification Rotor 1-10 | 60 | 20 | 40 | 82 | 57 | 82 | 73 | 0.36 | 1.00 | Parallel |
| Comparative Rotor 1-1 | 60 | 60 | 0 | 82 | 57 | — | — | — | — | — |
| Comparative Rotor 1-2 | 30 | 30 | 0 | 82 | 57 | — | — | — | — | — |
| Comparative Rotor 1-3 | 20 | 20 | 0 | 82 | 57 | — | — | — | — | — |
| Comparative Rotor 1-4 | 60 | 30 | 30 | 82 | 57 | 82 | 68 | 0.56 | 1.00 | — |
| Comparative Rotor 1-5 | 60 | 30 | 30 | 82 | 57 | 82 | 77 | 0.20 | 1.00 | — |
| Comparative Rotor 1-6 | 60 | 30 | 30 | 88 | 63 | 82 | 70 | 0.48 | 0.93 | — |
| Comparative Rotor 1-7 | 60 | 30 | 30 | 82 | 57 | 88 | 81 | 0.28 | 1.07 | — |
| Comparative Rotor 1-8 | 60 | 20 | 40 | 82 | 57 | 82 | 68 | 0.56 | 1.00 | — |
| Comparative Rotor 1-9 | 60 | 20 | 40 | 82 | 57 | 82 | 77 | 0.20 | 1.00 | — |

Example 1

Classification processing was performed over 60 cycles under conditions in which execution Classification Rotor 1-1 and Liner 2 were attached to a toner classification apparatus, a classification rotor rotation speed of 8,000 rpm, a dispersion rotor rotation speed of 7,000 rpm, a blower air volume of 6.0 $m^3$/min, and a classification cycle of 60 sec (input time of the particles to be classified of 10 sec, a classification process time of 30 sec, and a processed classified particle recovery time of 20 sec) were set, pulverized particle 1 for toner was used as the particle to be classified, the amount of input per cycle of the particles to be classified was 200 g, and thereby Toner 1-1 was obtained. In addition, the conditions were changed as shown in Table 2, and thereby Toners 1-2 to 1-10 and Comparative Toners 1-1 to 1-9 were obtained.

In addition, by the above measurement means, the weight-average particle diameter D4, the number % of 3 μm or less and the average circularity of Toners 1-1 to 1-11 and Comparative Toners 1-1 to 1-10 were measured. In addition, the classification yield was obtained from the amount of input of the particles to be classified (200 g×60 cycles) and the mass of the toner obtained, and the evaluation results are summarized in Table 2.

In addition, under respective classification conditions, the static pressure on the outlet side of the classification rotor before the particles to be classified were input (during idle operation) was subtracted from the static pressure on the inlet side of the classification rotor, and the A static pressure in front of and behind the classification rotor was calculated.

Evaluation 1-1: Yield Evaluation Criteria

A: a yield of 75.0% or more

B: a yield of 65.0% or more and less than 75.0%

C: a yield of 55.0% or more and less than 65.0%

D: a yield of less than 55.0%

Evaluation 1-2: Evaluation Criteria for A Static Pressure in front of and behind Classification Rotor A: less than 4.80 kPa B: 4.80 kPa or more and less than 5.00 kPa C: 5.00 kPa or more and less than 5.20 kPa D: 5.20 kPa or more Evaluation 1-3: Evaluation Criteria for the Number % of 3 μm or less A: less than 10.0 number %

B: 10.0 number % or more and less than 15.0 number %

C: 15.0 number % or more and less than 20.0 number %

D: 20.0 number % or more

Comprehensive Evaluation

A: All items used in Evaluations 1-1 to 1-3 had the rank A (very good)

B: At least one item in the lowest items of Evaluations 1-1 to 1-3 had the rank B (good)

C: At least one item in the lowest items of Evaluations 1-1 to 1-3 had the rank C D: At least one item in Evaluations 1-1 to 1-3 had the rank D (not acceptable in the present disclosure)

Reference Evaluation: Average Circularity

A: an average circularity of 0.960 or more (good)

B: an average circularity of less than 0.960

TABLE 2

Table 2

| | | Classification conditions | | | Evaluation | | | | | | | | | | |
|---|---|---|---|---|---|---|---|---|---|---|---|---|---|---|---|
| | Toner | Particles to be classified | Classification rotor | Liner | Yield | | Δ static pressure [kPa] | | D4 [μm] | The number % of 3 μm or less [number %] | | Comprehensive evaluation | Average circularity | |
| Example 1 | 1-1 | Pulverized particle 1 for toner | Classification rotor 1-1 | Liner 2 | 76.8% | A | 5.05 | C | 5.72 | 13.5 | B | C | 0.955 | B |

TABLE 2-continued

Table 2

| | Toner | Classification conditions: Particles to be classified | Classification conditions: Classification rotor | Classification conditions: Liner | Evaluation: Yield | | Δ static pressure [kPa] | | D4 [μm] | The number % of 3 μm or less [number %] | | Comprehensive evaluation | Average circularity | |
|---|---|---|---|---|---|---|---|---|---|---|---|---|---|---|
| | 1-2 | Pulverized particle 1 for toner | Classification rotor 1-2 | Liner 2 | 75.5% | A | 4.90 | B | 5.71 | 13.1 | B | B | 0.954 | B |
| | 1-3 | Pulverized particle 1 for toner | Classification rotor 1-3 | Liner 2 | 64.4% | C | 4.75 | A | 5.77 | 10.5 | B | C | 0.954 | B |
| | 1-4 | Pulverized particle 1 for toner | Classification rotor 1-4 | Liner 2 | 67.1% | B | 5.15 | C | 5.65 | 16.5 | C | C | 0.956 | B |
| | 1-5 | Pulverized particle 1 for toner | Classification rotor 1-5 | Liner 2 | 60.2% | C | 4.97 | B | 5.64 | 15.8 | C | C | 0.955 | B |
| | 1-6 | Pulverized particle 1 for toner | Classification rotor 1-6 | Liner 2 | 77.2% | A | 4.77 | A | 5.70 | 8.2 | A | A | 0.955 | B |
| | 1-7 | Pulverized particle 1 for toner | Classification rotor 1-6 | Liner 1 | 77.5% | A | 4.77 | A | 5.69 | 8.5 | A | A | 0.963 | A |
| | 1-8 | Pulverized particle 1 for toner | Classification rotor 1-7 | Liner 2 | 76.4% | A | 5.05 | C | 5.72 | 13.4 | B | C | 0.955 | B |
| | 1-9 | Pulverized particle 1 for toner | Classification rotor 1-8 | Liner 2 | 75.2% | A | 4.85 | B | 5.71 | 13.8 | B | B | 0.954 | B |
| | 1-10 | Pulverized particle 1 for toner | Classification rotor 1-9 | Liner 2 | 64.4% | C | 4.74 | A | 5.75 | 10.2 | B | C | 0.956 | B |
| | 1-11 | Pulverized particle 1 for toner | Classification rotor 1-10 | Liner 2 | 77.2% | A | 4.71 | A | 5.69 | 9.5 | A | A | 0.955 | B |
| Comparative Example 1 | Comparative 1-1 | Pulverized particle 1 for toner | Comparative rotor 1-1 | Liner 2 | 76.2% | A | 5.38 | D | 5.72 | 13.2 | B | D | 0.955 | B |
| | Comparative 1-2 | Pulverized particle 1 for toner | Comparative rotor 1-1 | Liner 1 | 75.8% | A | 5.39 | D | 5.70 | 13.5 | B | D | 0.962 | A |
| | Comparative 1-3 | Pulverized particle 1 for toner | Comparative rotor 1-2 | Liner 2 | 48.2% | D | 4.68 | A | 6.12 | 7.6 | A | D | 0.956 | B |
| | Comparative 1-4 | Pulverized particle 1 for toner | Comparative rotor 1-3 | Liner 2 | 30.2% | D | 4.52 | A | 6.52 | 4.8 | A | D | 0.955 | B |
| | Comparative 1-5 | Pulverized particle 1 for toner | Comparative rotor 1-4 | Liner 2 | 76.0% | A | 5.25 | D | 5.68 | 13.2 | B | D | 0.955 | B |
| | Comparative 1-6 | Pulverized particle 1 for toner | Comparative rotor 1-5 | Liner 2 | 53.2% | D | 4.72 | A | 6.02 | 9.5 | A | D | 0.955 | B |
| | Comparative 1-7 | Pulverized particle 1 for toner | Comparative rotor 1-6 | Liner 2 | 68.1% | B | 5.28 | D | 5.68 | 21.4 | D | D | 0.966 | B |
| | Comparative 1-8 | Pulverized particle 1 for toner | Comparative rotor 1-7 | Liner 2 | 57.2% | C | 5.08 | C | 5.68 | 20.2 | D | D | 0.954 | B |
| | Comparative 1-9 | Pulverized particle 1 for toner | Comparative rotor 1-8 | Liner 2 | 75.5% | A | 5.35 | D | 5.72 | 12.5 | B | D | 0.956 | B |
| | Comparative 1-10 | Pulverized particle 1 for toner | Comparative rotor 1-9 | Liner 2 | 35.8% | D | 4.57 | A | 6.42 | 5.2 | A | D | 0.955 | B |

Classification Rotors 2-1 to 2-10 used in Example 2

Classification rotor 2-1 used in Example 2 had a shape as shown in FIG. 2. The angle θ formed by a straight line connecting the center of rotation and the rotation center side end of the first vane and a straight line connecting the rotation center side end and the outer side end of the vane was 60°. One vane included in the second vane group was disposed between two adjacent vanes included in the first vane group. L1 was 82 mm, L2 was 57 mm, L3 was 82 mm, L4 was 70 mm, and the height of the opening of the classification rotor was 88 mm.

In addition, Table 3 shows parts of Classification rotors 2-1 to 2-8 that were different from Classification rotor 2-1.

Classification rotor 2-9 had a shape as shown in FIG. 10. The shape of the vanes included in the second vane group was adjusted so that the thickness on the outer side of the classification rotor was larger than the thickness on the inner side of the classification rotor, and the vanes were adjusted so that opposing surfaces of the vanes were parallel to each other.

Classification rotor 2-10 had a shape as shown in FIG. 11. Two vanes included in the second vane group were disposed between two adjacent vanes included in the first vane group. L1 was 82 mm, L2 was 57 mm, L3 was 82 mm, L4 was 73 mm, and the height of the opening of the classification rotor was 88 mm.

Comparative Rotors 2-1 to 2-6 used in Comparative Example 2

Figure 12:
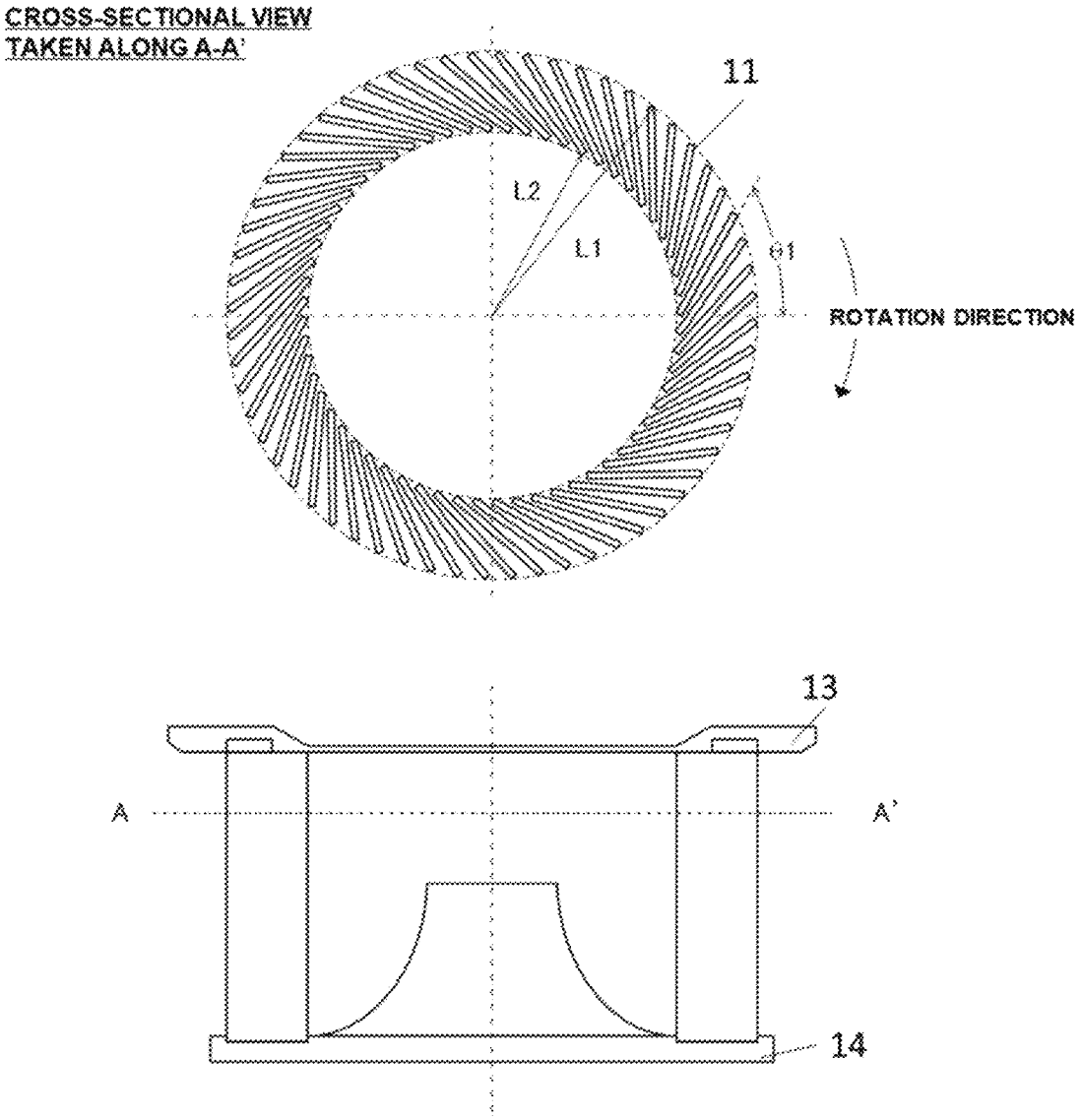
FIG. 12 is a schematic diagram of a classification rotor used in Comparative Example 2.

Comparative Rotor 2-1 used in Comparative Example 2 had a shape as shown in FIG. 12, L1 was 82 mm, L2 was 57 mm, and the height of the opening of the classification rotor was 88 mm.

Table 3 shows parts of Comparative Rotor 2-2 that were different from Comparative Rotor 2-1.

In addition, Table 3 shows parts of Comparative Rotors 2-3 to 2-6 that were different from Classification rotor 2-1.

Comparative Toners 2-1 to 2-7 were measured. In addition, the classification yield was obtained from the amount of input of the particles to be classified (200 g×60 cycles) and the mass of the toner obtained, and the evaluation results are summarized in Table 4.

In addition, under respective classification conditions, the static pressure on the inlet side of the classification rotor before the particles to be classified were input (during idle operation) was subtracted from the static pressure on the outlet side of the classification rotor, and the A static pressure in front of and behind the classification rotor was calculated.

Evaluation 2-1: Yield Evaluation Criteria

A: a yield of 70.0% or more

B: a yield of 60.0% or more and less than 70.0%

C: a yield of 50.0% or more and less than 60.0%

D: a yield of less than 50.0%

Evaluation 2-2: Evaluation Criteria for A Static Pressure in front of and behind Classification Rotor A: less than 7.40 kPa B: 7.40 kPa or more and less than 7.70 kPa C: 7.70 kPa or more and less than 8.00 kPa D: 8.00 kPa or more

TABLE 3

Table 3

| | Total number of vanes | Number of first vanes | Number of second vanes | L1 (mm) | L2 (mm) | L3 (mm) | L4 (mm) | (L3-L4)/(L1-L2) | L3/L1 | Formed angle θ (°) | Surfaces of adjacent vanes that face each other |
|---|---|---|---|---|---|---|---|---|---|---|---|
| Classification Rotor 2-1 | 60 | 30 | 30 | 82 | 57 | 82 | 70 | 0.48 | 1.00 | 60 | — |
| Classification Rotor 2-2 | 60 | 30 | 30 | 82 | 57 | 82 | 73 | 0.36 | 1.00 | 60 | — |
| Classification Rotor 2-3 | 60 | 30 | 30 | 82 | 57 | 82 | 75 | 0.28 | 1.00 | 60 | — |
| Classification Rotor 2-4 | 60 | 30 | 30 | 85 | 60 | 82 | 70 | 0.48 | 0.96 | 60 | — |
| Classification Rotor 2-5 | 60 | 30 | 30 | 82 | 57 | 85 | 78 | 0.28 | 1.04 | 60 | — |
| Classification Rotor 2-6 | 60 | 30 | 30 | 82 | 57 | 82 | 73 | 0.36 | 1.00 | 25 | — |
| Classification Rotor 2-7 | 60 | 30 | 30 | 82 | 57 | 82 | 73 | 0.36 | 1.00 | 35 | — |
| Classification Rotor 2-8 | 60 | 30 | 30 | 82 | 57 | 82 | 73 | 0.36 | 1.00 | 70 | — |
| Classification Rotor 2-9 | 60 | 30 | 30 | 82 | 57 | 82 | 73 | 0.36 | 1.00 | 60 | Parallel |
| Classification Rotor 2-10 | 60 | 20 | 40 | 82 | 57 | 82 | 73 | 0.36 | 1.00 | 60 | — |
| Comparative Rotor 2-1 | 60 | 60 | 0 | 82 | 57 | — | — | — | — | 60 | — |
| Comparative Rotor 2-2 | 30 | 30 | 0 | 82 | 57 | — | — | — | — | 60 | — |
| Comparative Rotor 2-3 | 60 | 30 | 30 | 82 | 57 | 82 | 68 | 0.56 | 1.00 | 60 | — |
| Comparative Rotor 2-4 | 60 | 30 | 30 | 82 | 57 | 82 | 77 | 0.20 | 1.00 | 60 | — |
| Comparative Rotor 2-5 | 60 | 30 | 30 | 88 | 63 | 82 | 70 | 0.48 | 0.93 | 60 | — |
| Comparative Rotor 2-6 | 60 | 30 | 30 | 82 | 57 | 88 | 81 | 0.28 | 1.07 | 60 | — |

Example 2

Classification processing was performed over 60 cycles under conditions in which execution Classification Rotors 2-1 and Liner 2 were attached to a toner classification apparatus, a classification rotor rotation speed of 9,000 rpm, a dispersion rotor rotation speed of 7,000 rpm, a blower air volume of 10 $m^3$/min, a classification cycle of 60 sec (input time of the particles to be classified of 10 sec, and a classification process time of 30 sec, and a processed classified particle recovery time of 20 sec) were set, pulverized particle 2 for toner was used as the particle to be classified, and amount of input per cycle of the particles to be classified was 200 g, and thereby Toner 2-1 was obtained. In addition, the conditions were changed as shown in Table 4, and thereby Toners 2-2 to 2-11 and Comparative Toners 2-1 to 2-7 were obtained.

In addition, by the above measurement means, the weight-average particle diameter D4, the number % of 3 μm or less and the average circularity of Toners 2-1 to 2-11 and Evaluation 2-3: Evaluation Criteria for the Number % of 3 μm or less A: less than 10.0 number %

B: 10.0 number % or more and less than 15.0 number %

C: 15.0 number % or more and less than 20.0 number %

D: 20.0 number % or more

Comprehensive Evaluation

A: All items in Evaluations 2-1 to 2-3 had the rank A (very good)

B: At least one item in the lowest items in Evaluations 2-1 to 2-3 had the rank B (good)

C: At least one item in the lowest items of Evaluations 2-1 to 2-3 had the rank C.

D: At least one item in Evaluations 2-1 to 2-3 had the rank D (not acceptable in the present disclosure)

Reference Evaluation: Average Circularity

A: an average circularity of 0.960 or more (good)

B: an average circularity of less than 0.960

TABLE 4

Table 4

| | | Classification conditions | | | Evaluation | | | | | | | | | | |
|---|---|---|---|---|---|---|---|---|---|---|---|---|---|---|---|
| | Toner | Particles to be classified | Classification rotor | Liner | Yield | | Δ static pressure [kPa] | | D4 [μm] | The number % of 3 μm or less [number %] | | Comprehensive evaluation | Average circularity | |
| Example 2 | 2-1 | Pulverized particle 2 for toner | Classification rotor 2-1 | Liner 2 | 73.4% | A | 7.81 | C | 4.82 | 13.2 | B | C | 0.956 | B |
| | 2-2 | Pulverized particle 2 for toner | Classification rotor 2-2 | Liner 2 | 71.2% | A | 7.52 | B | 4.83 | 13.3 | B | B | 0.954 | B |
| | 2-3 | Pulverized particle 2 for toner | Classification rotor 2-3 | Liner 2 | 58.5% | C | 7.25 | A | 4.80 | 12.5 | B | C | 0.954 | B |
| | 2-4 | Pulverized particle 2 for toner | Classification rotor 2-4 | Liner 2 | 67.8% | B | 7.52 | B | 4.72 | 17.2 | C | C | 0.955 | B |
| | 2-5 | Pulverized particle 2 for toner | Classification rotor 2-5 | Liner 2 | 55.2% | C | 7.88 | C | 4.75 | 16.5 | C | C | 0.954 | B |
| | 2-6 | Pulverized particle 2 for toner | Classification rotor 2-6 | Liner 2 | 58.2% | C | 7.05 | A | 4.76 | 14.5 | B | C | 0.956 | B |
| | 2-7 | Pulverized particle 2 for toner | Classification rotor 2-7 | Liner 2 | 65.2% | B | 7.15 | A | 4.78 | 12.4 | B | B | 0.955 | B |
| | 2-8 | Pulverized particle 2 for toner | Classification rotor 2-8 | Liner 2 | 73.2% | A | 7.91 | C | 4.85 | 9.5 | A | C | 0.955 | B |
| | 2-9 | Pulverized particle 2 for toner | Classification rotor 2-9 | Liner 2 | 73.5% | A | 7.23 | A | 4.81 | 8.7 | A | A | 0.954 | B |
| | 2-10 | Pulverized particle 2 for toner | Classification rotor 2-9 | Liner 1 | 73.6% | A | 7.23 | A | 4.80 | 8.6 | A | A | 0.962 | A |
| | 2-11 | Pulverized particle 2 for toner | Classification rotor 2-10 | Liner 2 | 71.0% | A | 7.51 | B | 4.83 | 13.3 | B | B | 0.955 | B |
| Comparative Example 2 | Comparative 2-1 | Pulverized particle 2 for toner | Comparative rotor 2-1 | Liner 2 | 73.2% | A | 9.20 | D | 4.82 | 13.4 | B | D | 0.955 | B |
| | Comparative 2-2 | Pulverized particle 2 for toner | Comparative rotor 2-1 | Liner 1 | 73.3% | A | 9.22 | D | 4.83 | 13.5 | B | D | 0.963 | A |
| | Comparative 2-3 | Pulverized particle 2 for toner | Comparative rotor 2-2 | Liner 2 | 44.2% | D | 7.21 | A | 5.02 | 18.5 | C | D | 0.954 | B |
| | Comparative 2-4 | Pulverized particle 2 for toner | Comparative rotor 2-3 | Liner 2 | 70.5% | A | 8.50 | D | 4.81 | 13.2 | B | D | 0.956 | B |
| | Comparative 2-5 | Pulverized particle 2 for toner | Comparative rotor 2-4 | Liner 2 | 48.2% | D | 7.34 | A | 5.11 | 9.5 | A | D | 0.954 | B |
| | Comparative 2-6 | Pulverized particle 2 for toner | Comparative rotor 2-5 | Liner 2 | 66.8% | B | 8.21 | D | 4.81 | 21.1 | D | D | 0.955 | B |
| | Comparative 2-7 | Pulverized particle 2 for toner | Comparative rotor 2-6 | Liner 2 | 55.3% | C | 7.85 | C | 4.95 | 21.5 | D | D | 0.955 | B |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-200999, filed Dec. 3, 2020, which is hereby incorporated by reference herein in its entirety.

What is claimed is:

1. A toner classification apparatus comprising a classification rotor, wherein the classification rotor comprises a plurality of vanes extending from a side of a center of rotation of the classification rotor to an outer circumference side of the classification rotor;

the plurality of vanes are disposed with prescribed gaps established between the vanes;

the gaps form an opening connecting a region of the center of rotation of the classification rotor;

the plurality of vanes comprise a first vane group containing first vanes and a second vane group containing second vanes, the second vanes have a length shorter than the first vanes;

the first vanes have substantially the same vane length, and are disposed with gaps established between the first vanes, each of the first vanes draws first trajectory when the classification rotor rotates, first trajectories drawn by the first vanes are substantially same;

the second vanes have substantially the same vane length, and are disposed with gaps established between the second vanes, each of the second vanes draws second trajectory when the classification rotor rotates, second trajectories drawn by the second vanes are substantially same;

the number of second vanes, which are disposed between two adjacent first vanes, is 1 to 2, independently;

a distance from the center of rotation to an outer circumference side end of the first trajectory is defined as L1 for the first trajectory, and a distance from the center of rotation to the center side end of the first trajectory is defined as L2, a distance from the center of rotation to an outer circumference side end of the second trajectory is defined as L3 for the second trajectory, and a distance from the center of rotation to the center side end of the second trajectory is defined as L4, L1 to L4 satisfy the following relationships:

$$0.25 \leq (L3-L4)/(L1-L2) \leq 0.50$$

$$0.95 \leq L3/L1 \leq 1.05.$$

2. The toner classification apparatus according to claim 1, wherein adjacent vanes are disposed with substantially equal gaps from each other.

3. The toner classification apparatus according to claim 1, wherein the following (1) or (2) is satisfied:

(1) when the number of second vanes, which are disposed between two adjacent first vanes, is 1, a surface of the second vane on the upstream side in a direction in which the classification rotor rotates is parallel to a surface of the first vane facing the surface and being on the downstream side in a direction in which the classification rotor rotates, and a surface of the second vane on the downstream side in a direction in which the classification rotor rotates is parallel to a surface of the first vane facing the surface and being on the upstream side in a direction in which the classification rotor rotates; and (2) when the number of second vanes, which are disposed between two adjacent first vanes, is 2, if a second vane having a surface facing a surface of the first vane on the downstream side in a direction in which the classification rotor rotates is defined as a second vane A, and a second vane having a surface facing a surface of the second vane A on the downstream side in a direction in which the classification rotor rotates is defined as a second vane B, a surface of the first vane on the downstream side in a direction in which the classification rotor rotates is parallel to a surface of the second vane A facing the surface and being on the upstream side in a direction in which the classification rotor rotates, a surface of the second vane A on the downstream side in a direction in which the classification rotor rotates is parallel to a surface of the second vane B facing the surface and being on the upstream side in a direction in which the classification rotor rotates, and a surface of the second vane B on the downstream side in a direction in which the classification rotor rotates is parallel to a surface of the first vane facing the surface and being on the upstream side in a direction in which the classification rotor rotates.

4. The toner classification apparatus according to claim 1, wherein the first vane is provided on the upstream side in a direction in which the classification rotor rotates from a rotation center side end of the classification rotor toward an outer circumference side end, and in a direction perpendicular to the axis of rotation of the classification rotor, in a transverse cross section when the classification rotor is cut away, an angle θ formed by a straight line connecting the center of rotation of the classification rotor and a rotation center side end of the first vane and a straight line connecting the rotation center side end of the first vane and the outer circumference side end of the first vane is 25° to 70°.

5. The toner classification apparatus according to claim 1, further comprising:

a body casing;

a guide means disposed in a state of overlapping at least a portion of the classification rotor;

an introduction port for a particle to be classified and a supply means for the particle to be classified having the introduction port for a particle to be classified formed in a side surface of the body casing in order to introduce the particle to be classified;

a particle having too small diameter discharge port and a classified particle take-off port formed in a side surface of the body casing in order to discharge, from the body casing, a classified particle from which a particle having too small diameter has been excluded; and a dispersion rotor being a rotating body attached within the body casing to the central rotational axle and having a dispersion hammer on the side surface of the classification rotor side of the dispersion rotor.

6. The toner classification apparatus according to claim 5, further comprising a liner disposed in a fixed manner at the circumference of the dispersion rotor while maintaining a distance therefrom.

7. The toner classification apparatus according to claim 6, wherein the liner is provided with a groove in the surface facing the dispersion rotor.

8. A toner production method comprising a classification step in which a particle to be classified is subjected to a classification process using a toner classification apparatus, wherein the toner classification apparatus is the toner classification apparatus according to claim 1.

* * * * *